US011458589B2

(12) United States Patent
Yagi et al.

(10) Patent No.: US 11,458,589 B2
(45) Date of Patent: Oct. 4, 2022

(54) POLISHING APPARATUS AND POLISHING MEMBER DRESSING METHOD

(71) Applicant: EBARA CORPORATION, Tokyo (JP)

(72) Inventors: Keita Yagi, Tokyo (JP); Yasumasa Hiroo, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 314 days.

(21) Appl. No.: 16/721,758

(22) Filed: Dec. 19, 2019

(65) Prior Publication Data

US 2020/0198094 A1 Jun. 25, 2020

(30) Foreign Application Priority Data

Dec. 21, 2018 (JP) ..... JP2018-240102
Dec. 26, 2018 (JP) ..... JP2018-243656

(51) Int. Cl.
*B24B 53/017* (2012.01)
*B24B 37/20* (2012.01)

(52) U.S. Cl.
CPC ..... *B24B 53/017* (2013.01); *B24B 37/20* (2013.01)

(58) Field of Classification Search
CPC ... B24B 53/017; B24B 53/001; B24B 53/005; B24B 53/02; B24B 37/20; B24B 49/10; B24B 49/105; B24B 49/12
USPC ..... 451/56
See application file for complete search history.

(56) References Cited

U.S. PATENT DOCUMENTS

| | | | | |
|---|---|---|---|---|
| 6,113,462 | A | 9/2000 | Yang | |
| 9,156,130 | B2 * | 10/2015 | Shimano | B24B 37/005 |
| 10,391,623 | B2 | 8/2019 | Pedersen | |
| 2014/0342642 | A1 | 11/2014 | Shimano et al. | |

FOREIGN PATENT DOCUMENTS

| | | | |
|---|---|---|---|
| JP | 2000-000761 | A | 1/2000 |
| JP | 2010-076049 | A | 4/2010 |
| JP | 2012-254490 | A | 12/2012 |
| JP | 2013-525128 | A | 6/2013 |
| JP | 2014-161938 | A | 9/2014 |
| JP | 2014-161944 | A | 9/2014 |
| JP | 2015-125444 | A | 7/2015 |
| JP | 2016-175146 | A | 10/2016 |

OTHER PUBLICATIONS

STIC Search Report (Year: 2022).*

* cited by examiner

*Primary Examiner* — Joseph J Hail
*Assistant Examiner* — Caleb Andrew Holizna
(74) *Attorney, Agent, or Firm* — BakerHostetler

(57) ABSTRACT

A dresser is enabled to adjust a swing speed in scanning areas set on a polishing member along a swing direction. A surface height of the polishing member in monitoring areas set in advance on the polishing member along the swing direction of the dresser is measured. A dress model matrix defined from the monitoring areas, the scanning areas and a dress model is created. Height profile predicted value is calculated using the dress model and the swing speed in each scanning area or a staying time. Evaluation index is set based on a difference from a target value of a height profile of the polishing member and a step of setting the swing speed in each scanning area of the dresser based on the evaluation index. At least one of parameters to determine the target value or the evaluation index of the height profile is made to change automatically.

5 Claims, 23 Drawing Sheets

(a) Pad Swelling etc. Correction (b) No Pad Swelling etc. Correction (a) Pad Swelling etc. Correction (b) No Pad Swelling etc. Correction (a) Pad Swelling etc. Correction (b) No Pad Swelling etc. Correction (a) Pad Swelling etc. Correction (b) No Pad Swelling etc. Correction

POLISHING APPARATUS AND POLISHING MEMBER DRESSING METHOD

CROSS-REFERENCE TO RELATED APPLICATIONS

This application claims the benefit of Japanese Priority Patent Application JP 2018-240102 filed on Dec. 21, 2018 and JP 2018-243656 filed on Dec. 26, 2018, the entire contents of which are incorporated herein by reference.

BACKGROUND OF THE INVENTION

Field of the Invention

The present invention relates to a dressing method for a polishing member to polish a substrate such as a wafer and a polishing apparatus.

Description of the Related Art

As high-density integration of semiconductor devices advances, circuit wiring is becoming finer and dimensions of integrated devices are also becoming smaller. Steps of polishing a wafer having a metallic film or the like formed on its surface and flattening the surface of the wafer are therefore needed. One such flattening method is polishing by a chemical-mechanical polishing (CMP) apparatus. The chemical-mechanical polishing apparatus includes a polishing member (polishing cloth, polishing pad or the like) and a holding portion (top ring, polishing head, chuck or the like) for holding a polishing target such as a wafer. While supplying a polishing liquid (abrasive liquid, chemical liquid, slurry, pure water or the like) between the polishing member and the polishing target, the chemical-mechanical polishing apparatus pushes the surface of the polishing target (polished surface) against the surface of the polishing member and causes the polishing member and the polishing target to relatively move with respect to each other, and thereby polishes the surface of the polishing target flat.

Foamed resin or non-woven fabric cloth is generally used as a polishing member material used for such a chemical-mechanical polishing apparatus. The polishing member has fine projections and depressions on its surface and the fine projections and depressions act as a chip pocket which is effective in preventing clogging or reducing polishing resistance. However, continued polishing of the polishing target with the polishing member may cause the fine projections and depressions on the surface of the polishing member to be crushed and cause a reduction of a polishing rate. Therefore, the polishing member surface is dressed using a dresser in which many abrasive grains such as diamond particles are electrodeposited, and the fine projections and depressions are reconstructed on the polishing member surface.

As a dressing method for the polishing member, for example, dressing is performed while moving (circular or linear reciprocating motion or swinging) a rotating dresser, with the dressing surface being pushed against the rotating polishing member. When dressing the polishing member, a minute amount of the surface of the polishing member is shaved. Therefore, inappropriate dressing may result in inappropriate undulation on the surface of the polishing member, causing inconvenience of producing a variation within the polishing rate in the polished surface. The variation in the polishing rate may cause a polishing defect, and it is therefore necessary to perform dressing appropriately so as to prevent inappropriate undulation on the surface of the polishing member. That is, variations in the polishing rate are avoided by performing dressing under appropriate dressing conditions such as an appropriate rotation speed of the polishing member, an appropriate rotation speed of the dresser, an appropriate dressing load and an appropriate moving speed of the dresser.

In a polishing apparatus disclosed in Patent Literature 1 (Japanese Patent Laid-Open No. 2014-161944), a plurality of swing sections are set in a swing direction of a dresser, a difference between a current profile obtained from a measured value of a surface height of a polishing member in each swing section and a target profile is calculated and a moving speed of the dresser in each swing section is corrected so as to eliminate the difference.

However, when, for example, the difference from the target profile is large, the variation in the dresser moving speed in each swing section increases even using the correction method disclosed in the above-described Patent Literature, and the dresser moving speed is not stable, and as a result, the intended profile of the polishing member cannot be obtained.

The height (thickness) of a polishing member normally decreases gradually at a constant rate in accordance with the polishing processing on a wafer W. However, when the wafer W is not processed for a while, the polishing member may swell with moisture and the height of the polishing member may thereby increase. On the contrary, when the wafer W is not processed for a while, the polishing member may contract and the height of the polishing member may thereby decrease considerably.

The amount of swelling/contraction of the polishing member fluctuates depending on a type of the polishing member and a mode in use of the apparatus, but if the height of the polishing member fluctuates discontinuously due to swelling/contraction, a cut rate, and therefore the moving speed of the dresser cannot be calculated or the calculated value may be abnormal. In such a case, the performance of the polishing apparatus may be affected.

It is an object of the present invention to provide a method for implementing a profile of a target polishing member and dressing the polishing member. It is another object of the present invention to provide a method for implementing a profile of a target polishing member even when the height of the polishing member fluctuates discontinuously due to swelling/contraction and dressing the polishing member. It is a further object of the present invention to provide a polishing apparatus capable of executing a method for dressing such a polishing member.

SUMMARY OF THE INVENTION

According to an aspect of the present invention, a method for dressing a polishing member by causing a dresser to swing on the polishing member used for a polishing apparatus for a substrate, the dresser being enabled to adjust a swing speed in a plurality of scan areas set on the polishing member along a swing direction, the method comprising: a step of measuring a surface height of the polishing member in a plurality of monitoring areas set in advance on the polishing member along the swing direction of the dresser; a step of creating a dress model matrix defined from the monitoring areas, the scan areas and a dress model; a step of calculating a height profile predicted value using the dress model and the swing speed in each scan area or a staying time; a step of setting an evaluation index based on a difference from a target value of a height profile of the polishing member; and a step of setting the swing speed in each scan area of the dresser based on the evaluation index, wherein at least one of parameters to determine the target value of the height profile or the evaluation index is made to change automatically.

According to another aspect of the present invention, a method for dressing a polishing member by causing a dresser to swing on the polishing member used for a polishing apparatus for a substrate, the dresser being enabled to adjust a swing speed in a plurality of scan areas set on the polishing member along a swing direction, the method comprising: a step of measuring a surface height of the polishing member in a plurality of monitoring areas set in advance on the polishing member along the swing direction of the dresser; a step of correcting the surface height of the polishing member based on a measurement interval of the surface height and an amount of fluctuation in a measured value of the surface height; a step of creating a dress model matrix defined from the monitoring area, the scan area and a dress model; a step of calculating a height profile predicted value using the dress model and the swing speed in each scan area or a staying time; a step of setting an evaluation index based on a difference from a target value of a height profile of the polishing member; and a step of setting the swing speed in each scan area of the dresser based on the evaluation index.

DETAILED DESCRIPTION OF THE PREFERRED EMBODIMENTS

First Embodiment

Figure 1:
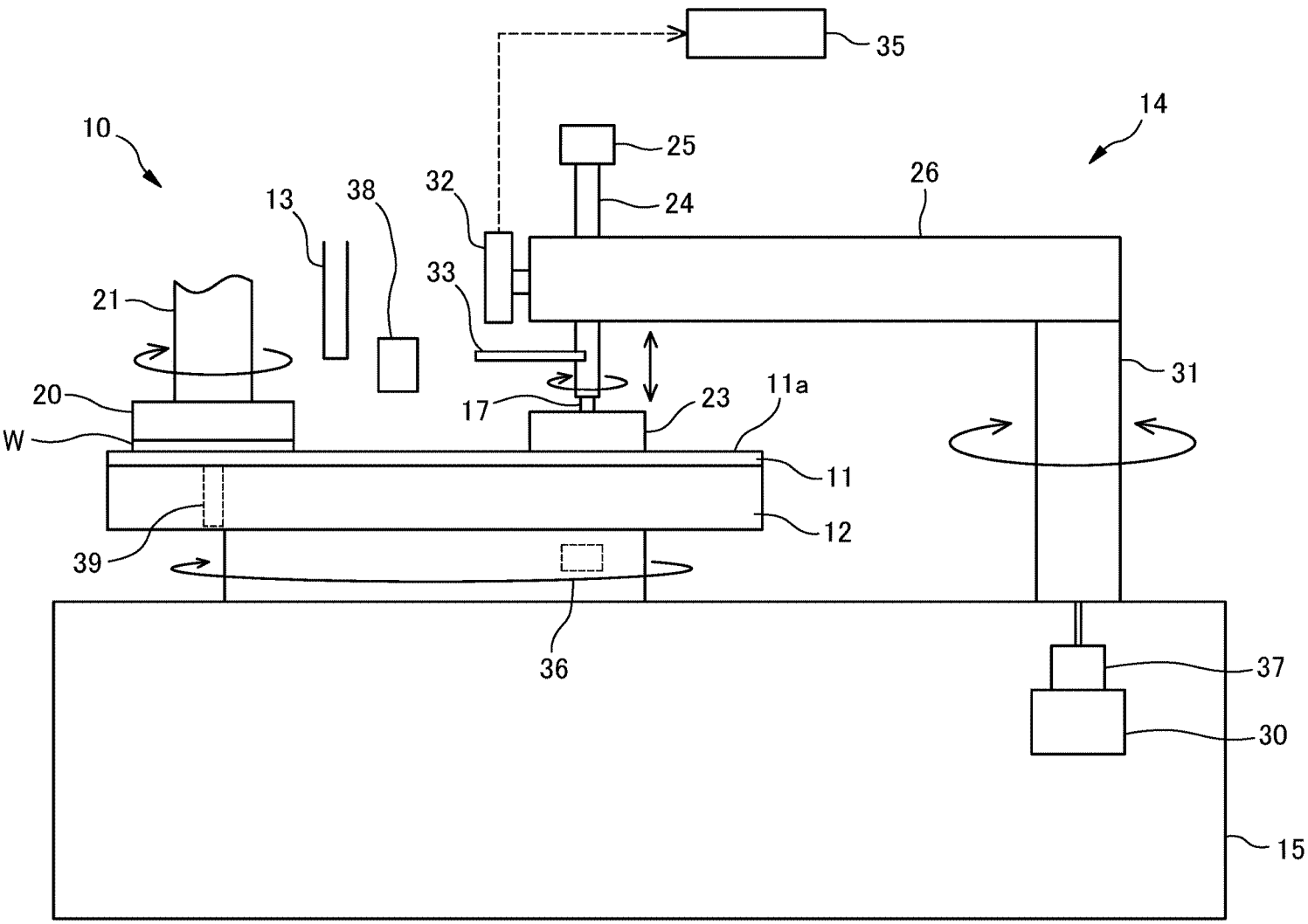
FIG. 1 is a schematic view illustrating a polishing apparatus that polishes a substrate such as a wafer.

An embodiment of the present invention will be described with reference to the accompanying drawings. FIG. 1 is a schematic view illustrating a polishing apparatus that polishes a substrate such as a wafer. The polishing apparatus is provided on a substrate processing apparatus that can perform a series of steps of polishing, cleaning and drying a wafer.

As shown in FIG. 1, the polishing apparatus is provided with a polishing unit 10 for polishing a wafer W, a polishing table 12 that holds a polishing pad (polishing member) 11, a polishing liquid supply nozzle 13 that supplies a polishing liquid to the polishing pad 11, and a dressing unit 14 that performs conditioning (dressing) on the polishing pad 11 used to polish the wafer W. The polishing unit 10 and the dressing unit 14 are set on a base 15.

The polishing unit 10 is provided with a top ring (substrate holding section) 20 connected at a bottom end of a top ring shaft 21. The top ring 20 is configured to hold the wafer W on an undersurface thereof by means of vacuum suctioning. The top ring shaft 21 is rotated driven by a motor (not shown) and the rotation of the top ring shaft 21 causes the top ring 20 and the wafer W to rotate. The top ring shaft 21 is configured to move in a vertical direction relative to the polishing pad 11 by a vertical movement mechanism (not shown) (e.g., vertical movement mechanism composed of a servo motor and a ball screw).

The polishing table 12 is connected to a motor (not shown) disposed therebelow. The polishing table 12 is rotated by the motor around a shaft center thereof. The polishing pad 11 is pasted to a top surface of the polishing table 12 and a top surface of the polishing pad 11 constitutes a polishing surface 11*a* for polishing the wafer W.

The wafer W is polished as follows. The top ring 20 and the polishing table 12 are caused to rotate respectively and a polishing liquid is supplied to the polishing pad 11. In this condition, the top ring 20 holding the wafer W is caused to descend and the wafer W is pushed against a polishing surface 11*a* of the polishing pad 11 through a pressurizing mechanism (not shown) made up of an airbag set in the top ring 20. The wafer W and the polishing pad 11 are brought into slidable contact with each other in the presence of the polishing liquid and the surface of the wafer W is thereby polished and flattened.

The dressing unit 14 is provided with a dresser 23 that comes into contact with the polishing surface 11*a* of the polishing pad 11, a dresser shaft 24 connected to the dresser 23, an air cylinder 25 provided at a top end of the dresser shaft 24 and a dresser arm 26 that rotatably supports the dresser shaft 24. Abrasive grains such as diamond particles are fixed to an undersurface of the dresser 23. The undersurface of the dresser 23 constitutes a dressing surface for dressing the polishing pad 11.

The dresser shaft 24 and the dresser 23 are movable in the vertical direction with respect to the dresser arm 26. The air cylinder 25 is an apparatus that gives a dressing load on the polishing pad 11 to the dresser 23. The dressing load is adjustable by an air pressure supplied to the air cylinder 25.

The dresser arm 26 is configured to be driven by a motor 30 and swing around a spindle 31. The dresser shaft 24 is caused to rotate by a motor (not shown) disposed in the dresser arm 26 and the rotation of the dresser shaft 24 causes the dresser 23 to rotate around a shaft center thereof. The air cylinder 25 pushes the dresser 23 against the polishing surface 11*a* of the polishing pad 11 with a predetermined load via the dresser shaft 24.

Conditioning of the polishing surface 11*a* of the polishing pad 11 is performed as follows. The polishing table 12 and the polishing pad 11 are caused to rotate by the motor and a dressing liquid (e.g., pure water) is supplied from a dressing liquid supply nozzle (not shown) to the polishing surface 11*a* of the polishing pad 11. Furthermore, the dresser 23 is caused to rotate around the shaft center thereof. The dresser 23 is pressed against the polishing surface 11*a* by the air cylinder 25 to cause the undersurface (dressing surface) of the dresser 23 to slidably contact with the polishing surface 11*a*. In this condition, the dresser arm 26 is caused to turn and the dresser 23 on the polishing pad 11 is caused to swing in a substantially radius direction of the polishing pad 11. The polishing pad 11 is shaved by the rotating dresser 23 and conditioning of the polishing surface 11*a* is thereby performed.

A pad height sensor (surface height measuring instrument) 32 for measuring a height of the polishing surface 11*a* is fixed to the dresser arm 26. A sensor target 33 located opposed to the pad height sensor 32 is fixed to the dresser shaft 24. The sensor target 33 moves in the vertical direction together with the dresser shaft 24 and the dresser 23, whereas the position in the vertical direction of the pad height sensor 32 is fixed. The pad height sensor 32 is a displacement sensor and can indirectly measure the height (thickness of the polishing pad 11) of the polishing surface 11*a* by measuring displacement of the sensor target 33. Since the sensor target 33 is connected to the dresser 23, the pad height sensor 32 can measure the height of the polishing surface 11*a* during conditioning of the polishing pad 11.

The pad height sensor 32 measures the height of the polishing surface 11*a* in a plurality of predetermined areas (monitoring areas) divided in the radius direction of the polishing pad. The pad height sensor 32 indirectly measures the polishing surface 11*a* from a position in the vertical direction of the dresser 23 which is in contact with the polishing surface 11*a*. Therefore, the pad height sensor 32 measures an average of the height of the polishing surface 11*a* in an area (certain monitoring area) with which the undersurface (dressing surface) of the dresser 23 is in contact, and measures the height of the polishing pad in a plurality of monitoring areas, and is thereby capable of obtaining a profile of the polishing pad (cross-sectional shape of the polishing surface 11*a*). As the pad height sensor 32, any types of sensors can be used such as a linear scale sensor, a laser type sensor, an ultrasonic sensor or an eddy current type sensor.

The pad height sensor 32 is connected to a dressing monitoring apparatus 35 and an output signal of the pad height sensor 32 (that is, a measured value of the height of the polishing surface 11*a*) is sent to the dressing monitoring apparatus 35. The dressing monitoring apparatus 35 acquires the profile of the polishing pad 11 from the measured value of the height of the polishing surface 11*a* and is further provided with a function of determining whether or not conditioning of the polishing pad 11 is correctly in progress.

The polishing apparatus is provided with a table rotary encoder 36 that measures an angle of rotation of the polishing table 12 and polishing pad 11 and a dresser rotary encoder 37 that measures a turning angle of the dresser 23. These table rotary encoder 36 and dresser rotary encoder 37 are absolute encoders that measure absolute values of angles. These rotary encoders 36 and 37 are connected to the dressing monitoring apparatus 35, and the dressing monitoring apparatus 35 can acquire the information of the angles of rotation of the polishing table 12 and the polishing pad 11 and further the turning angle of the dresser 23 during height measurement of the polishing surface 11*a* by the pad height sensor 32.

Figure 2:
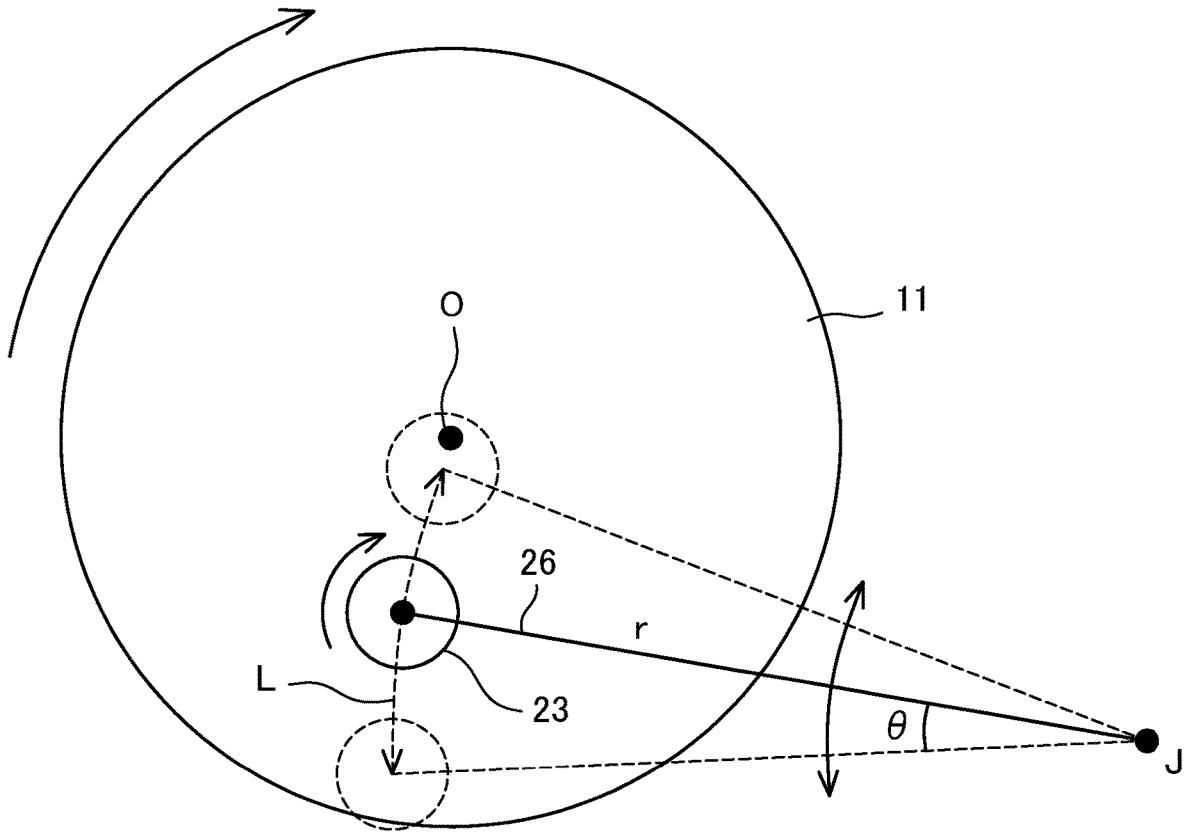
FIG. 2 is a plan view schematically illustrating a dresser and a polishing pad.

The dresser 23 is connected to the dresser shaft 24 via a universal joint 17. The dresser shaft 24 is connected to a motor (not shown). The dresser shaft 24 is rotatably supported by the dresser arm 26 and the dresser arm 26 causes the dresser 23 to swing in a radius direction of the polishing pad 11 while being in contact with the polishing pad 11 as shown in FIG. 2. The universal joint 17 is configured to transmit the rotation of the dresser shaft 24 to the dresser 23 while allowing tilt of the dresser 23. The dresser 23, the universal joint 17, the dresser shaft 24, the dresser arm 26 and a rotation mechanism (not shown) or the like constitute the dressing unit 14. The dressing monitoring apparatus 35 for calculating a sliding distance and a sliding speed of the dresser 23 is electrically connected to the dressing unit 14. A dedicated or general-purpose computer may be used as the dressing monitoring apparatus 35.

Abrasive grains such as diamond particles are fixed to the undersurface of the dresser 23. The portion to which the abrasive grains are fixed constitutes the dressing surface for dressing the polishing surface of the polishing pad 11. Examples of aspects of the applicable dressing surface include a circular dressing surface (dressing surface on which abrasive grains are fixed to the entire undersurface of the dresser 23), a ring-shaped dressing surface (dressing surface on which abrasive grains are fixed to peripheral edges of the undersurface of the dresser 23) or a plurality of circular dressing surfaces (dressing surface on which abrasive grains are fixed to surfaces of a plurality of small-diameter pellets arrayed at substantially equal intervals around the center of the dresser 23). Note that the dresser 23 in the present embodiment is provided with the circular dressing surface.

When the polishing pad 11 is dressed, the polishing pad 11 is caused to rotate in a direction shown by an arrow at a predetermined rotational speed as shown in FIG. 1, and the dresser 23 is caused by a rotation mechanism (not shown) to rotate in a direction shown by an arrow at a predetermined rotational speed. In this condition, the dressing surface of the dresser 23 (surface on which abrasive grains are placed) is pressed against the polishing pad 11 with a predetermined dressing load and the polishing pad 11 is dressed. The dresser arm 26 causes the dresser 23 to swing over the polishing pad 11, and can thereby perform dressing of the area used in polishing of the polishing pad 11 (polishing area, that is, area for polishing a polishing target such as a wafer).

Since the dresser 23 is connected to the dresser shaft 24 via the universal joint 17, even when the dresser shaft 24 is slightly tilted with respect to the surface of the polishing pad 11, the dressing surface of the dresser 23 is appropriately brought into contact with the polishing pad 11. A pad surface roughness measuring device 38 for measuring surface roughness of the polishing pad 11 is disposed above the polishing pad 11. As the pad surface roughness measuring device 38, a publicly known non-contact type surface roughness measuring device of an optical type or the like may be used. The pad surface roughness measuring device 38 is connected to the dressing monitoring apparatus 35 and measured values of surface roughness of the polishing pad 11 is sent to the dressing monitoring apparatus 35.

A film thickness sensor (film thickness measuring instrument) 39 for measuring a film thickness of the wafer W is disposed in the polishing table 12. The film thickness sensor 39 is disposed so as to face the surface of the wafer W held to the top ring 20. The film thickness sensor 39 is a film thickness measuring instrument that measures the film thickness of the wafer W while moving across the surface of the wafer W along with the rotation of the polishing table 12. As the film thickness sensor 39, a non-contact type sensor such as an eddy current sensor or an optical sensor may be used. A measured value of the film thickness is sent to the dressing monitoring apparatus 35. The dressing monitoring apparatus 35 is configured to generate a film thickness profile of the wafer W (a film thickness distribution along the radius direction of the wafer W) from the measured value of the film thickness.

Next, swinging of the dresser 23 will be described with reference to FIG. 2. The dresser arm 26 turns around a point J clockwise and counterclockwise by a predetermined angle. The position of the point J corresponds to the center position of the spindle 31 shown in FIG. 1. As the dresser arm 26 turns, the rotation center of the dresser 23 swings in the radius direction of the polishing pad 11 within a range shown by a circular arc L.

Figure 3:
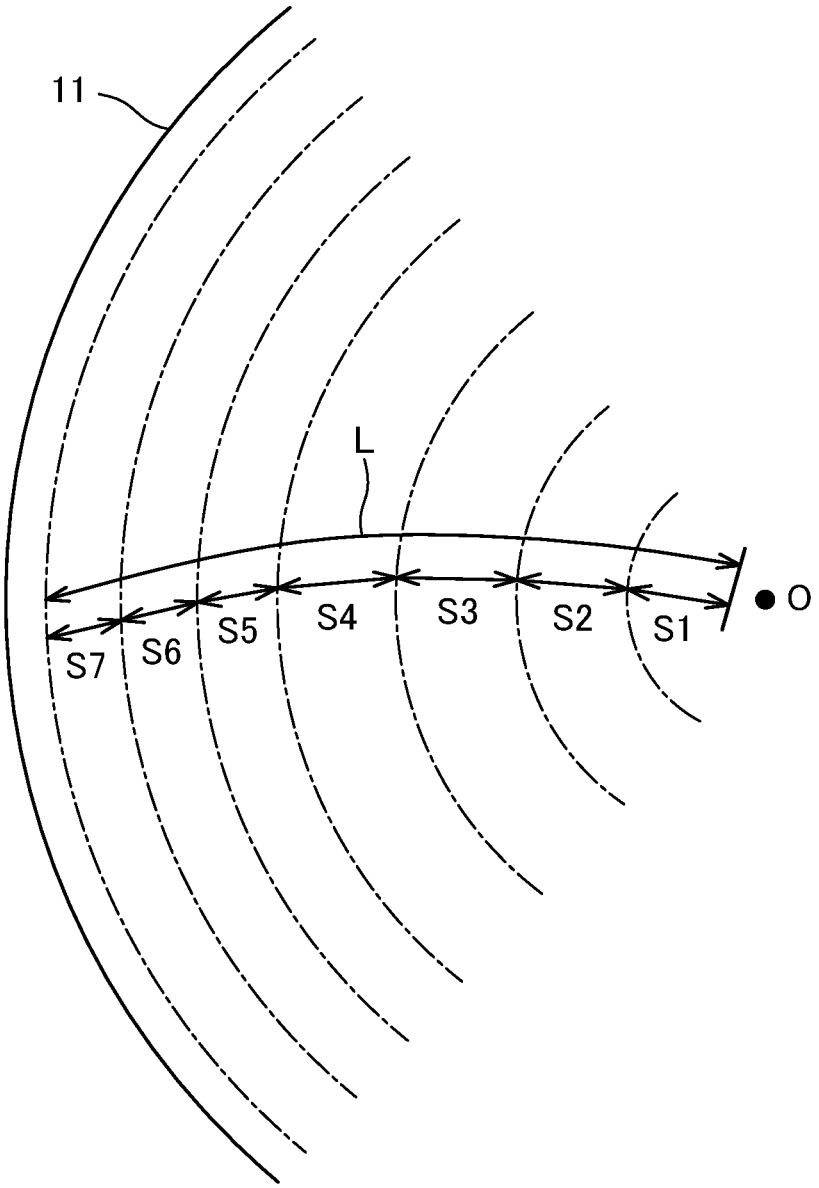
FIG. 3 is a diagram illustrating an example of scanning areas set in the polishing pad.

FIG. 3 is an enlarged view of the polishing surface 11*a* of the polishing pad 11. As shown in FIG. 3, the swing range (swing width L) of the dresser 23 is divided into a plurality of (7 in the example in FIG. 3) scanning areas (swing sections) S1 to S7. These scanning areas S1 to S7 are virtual spaces set in advance on the polishing surface 11*a* and arranged side by side along the swing direction of the dresser 23 (that is, roughly in the radius direction of the polishing pad 11). The dresser 23 dresses the polishing pad 11 while moving across these scanning areas S1 to S7. Lengths of the scanning areas S1 to S7 may be identical or different from each other.

Figure 4:
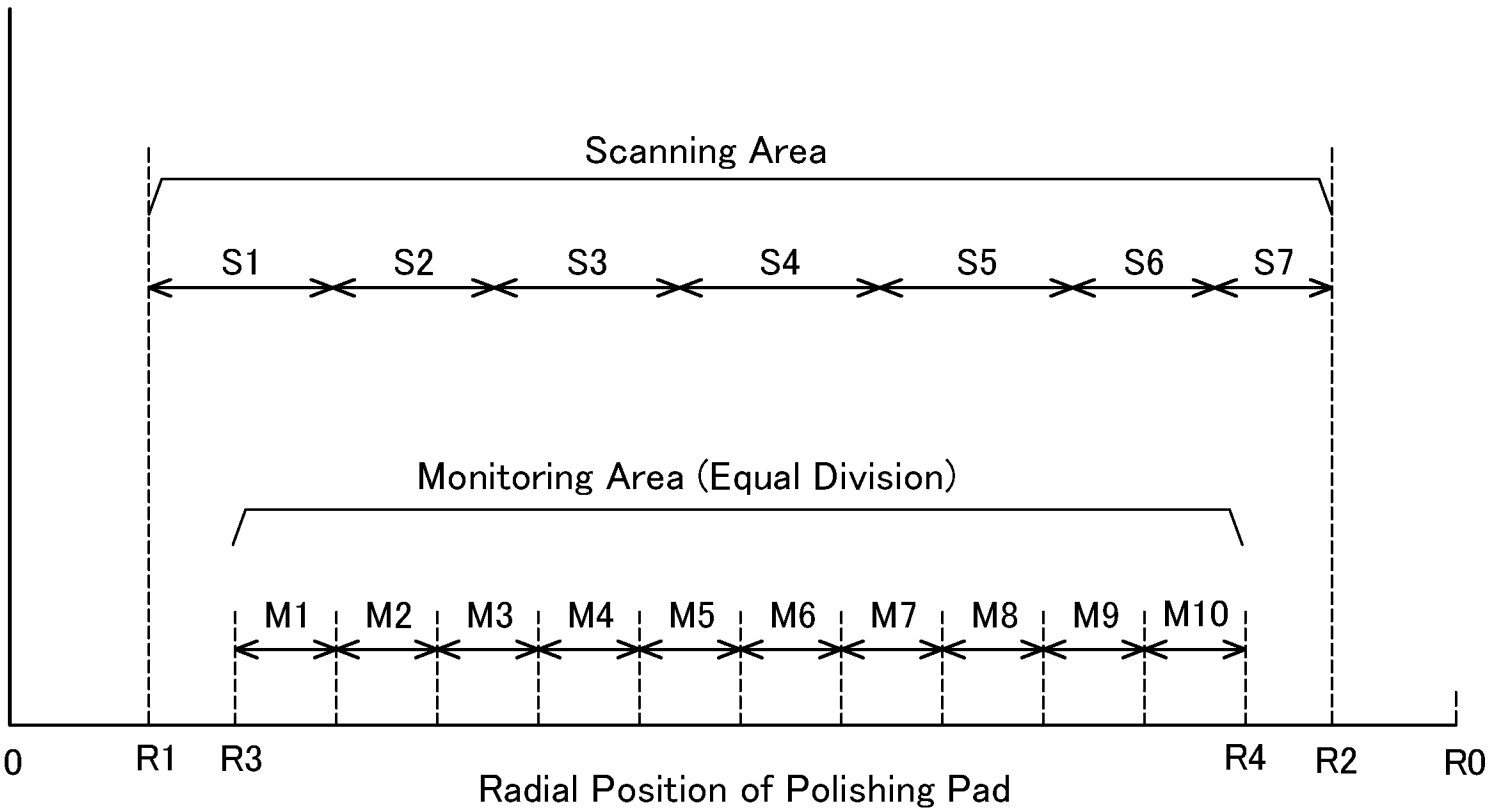
FIG. 4 is an explanatory diagram illustrating a relationship between scanning areas and monitoring areas of the polishing pad.

FIG. 4 is an explanatory diagram illustrating a positional relationship between scanning areas S1 to S7 and monitoring areas M1 to M10 of the polishing pad 11 and the horizontal axis in FIG. 4 represents a distance from the center of the polishing pad 11. A case is shown in the present embodiment as an example where seven scanning areas and ten monitoring areas are set, but the numbers of scanning areas and monitoring areas may be changed as appropriate. Since it is difficult to control the pad profile in an area having a width corresponding to the radius of the dresser 23 from both ends of the scanning areas, monitoring exclusion widths are provided inside (areas R1 to R3 from the center of the pad) and outside (areas R4 to R2 from the center of the pad), but monitor exclusion widths need not always be provided.

The moving speed of the dresser 23 when swinging over the polishing pad 11 is set for each scanning area S1 to S7 in advance and can also be adjusted as appropriate. The moving speed distribution of the dresser 23 represents the moving speed of the dresser 23 in each scanning area S1 to S7.

The moving speed of the dresser 23 is one of determining elements of the pad height profile of the polishing pad 11. The cut rate of the polishing pad 11 represents an amount (thickness) per unit time of the polishing pad 11 shaved by the dresser 23. When the dresser is moved at a constant speed, the thickness of the polishing pad 11 shaved in each scanning area normally differs from one scanning area to another, and so the numerical value of the cut rate also differs from one scanning area to another. However, since it is normally preferable to keep the initial shape of the pad profile, the moving speed is adjusted so as to decrease the difference in the amount of shaving for each scanning area.

Here, increasing the moving speed of the dresser 23 means shortening the staying time of the dresser 23 on the polishing pad 11, that is, reducing the amount of shaving of the polishing pad 11. On the other hand, decreasing the moving speed of the dresser 23 means increasing the staying time of the dresser 23 on the polishing pad 11, that is, increasing the amount of shaving of the polishing pad 11. Therefore, by increasing the moving speed of the dresser 23 in a certain scanning area, it is possible to reduce the amount of shaving in the scanning area, and by decreasing the moving speed of the dresser 23 in a certain scanning area, it is possible to increase the amount of shaving in the scanning area. Thus, the pad height profile of the whole polishing pad can be adjusted.

Figure 5:
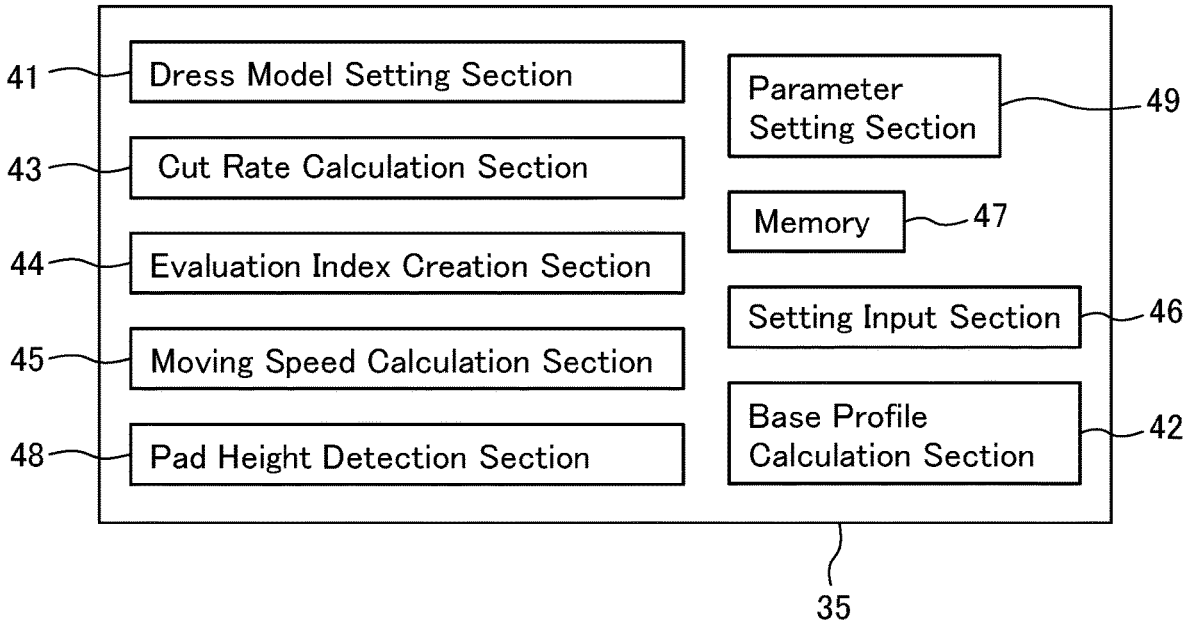
FIG. 5 is a block diagram illustrating an example of a configuration of a dresser monitoring apparatus.

As shown in FIG. 5, the dressing monitoring apparatus 35 is provided with a dress model setting section 41, a base profile calculation section 42, a cut rate calculation section 43, an evaluation index creation section 44, a moving speed calculation section 45, a setting input section 46, a memory 47, a pad height detection section 48, and a parameter setting section 49, and is configured to acquire a profile of the polishing pad 11 and set the moving speed of the dresser 23 to be optimum in scanning areas at predetermined timing.

The dress model setting section 41 sets a dress model S to calculate an amount of polishing of the polishing pad 11 in a scanning area. The dress model S is a real number matrix with m rows and n columns when it is assumed that the number of division of monitoring areas is m (10 in the present embodiment), the number of division of monitoring areas is n (7 in the present embodiment), and is determined by various parameters which will be described later.

When it is assumed that the scanning speed of the dresser in each scanning area set by the polishing pad 11 is $V=[v_1, v_2, \ldots, v_n]$, the width of each scanning area is $W=[w_1, w_2, \ldots, w_n]$, the staying time of (the center of) the dresser in each scanning area is expressed by:

$$T=W/V=[w_1/v_1, w_2/v_2, \ldots, w_n/v_n]$$

At this time, when an amount of wear of the pad in each monitoring area is assumed to be $U=[u_1, u_2, \ldots, u_m]$, the amount of wear of the pad U is calculated by carrying out a matrix calculation of U=ST using the aforementioned dress model S and the staying time T in each scanning area.

To derive the dress model matrix S, it is possible to consider elements of 1) a cut rate model, 2) a dresser diameter and 3) scanning speed control and combine these elements as appropriate. The cut rate model is set on the assumption that each element of the dress model matrix S is proportional to the staying time in the monitoring area or proportional to scratch distance (moving distance).

Regarding the dresser diameter, each element of the dress model matrix S is set on the assumption that the dresser diameter is taken into consideration (the polishing pad is worn according to the same cut rate over the entire effective area of the dresser) or not taken into consideration (according to the cut rate only at the center position of the dresser). When the dresser diameter is taken into consideration, it is possible to define an appropriate dress model also for a dresser in which diamond particles are applied in a ring shape, for example. Furthermore, regarding the scanning speed control, each element of the dress model matrix S is set depending on whether a change in the moving speed of the dresser is in a stepped shape or slope shape. By combining these parameters as appropriate, it is possible to calculate an amount of cut that matches the embodiment from the dress model S and calculate a correct profile predicted value.

The pad height detection section 48 is configured to detect the pad height in each monitoring area by associating height data of the polishing pad consecutively measured by the pad height sensor 32 with measurement coordinate data on the polishing pad.

Figure 6:
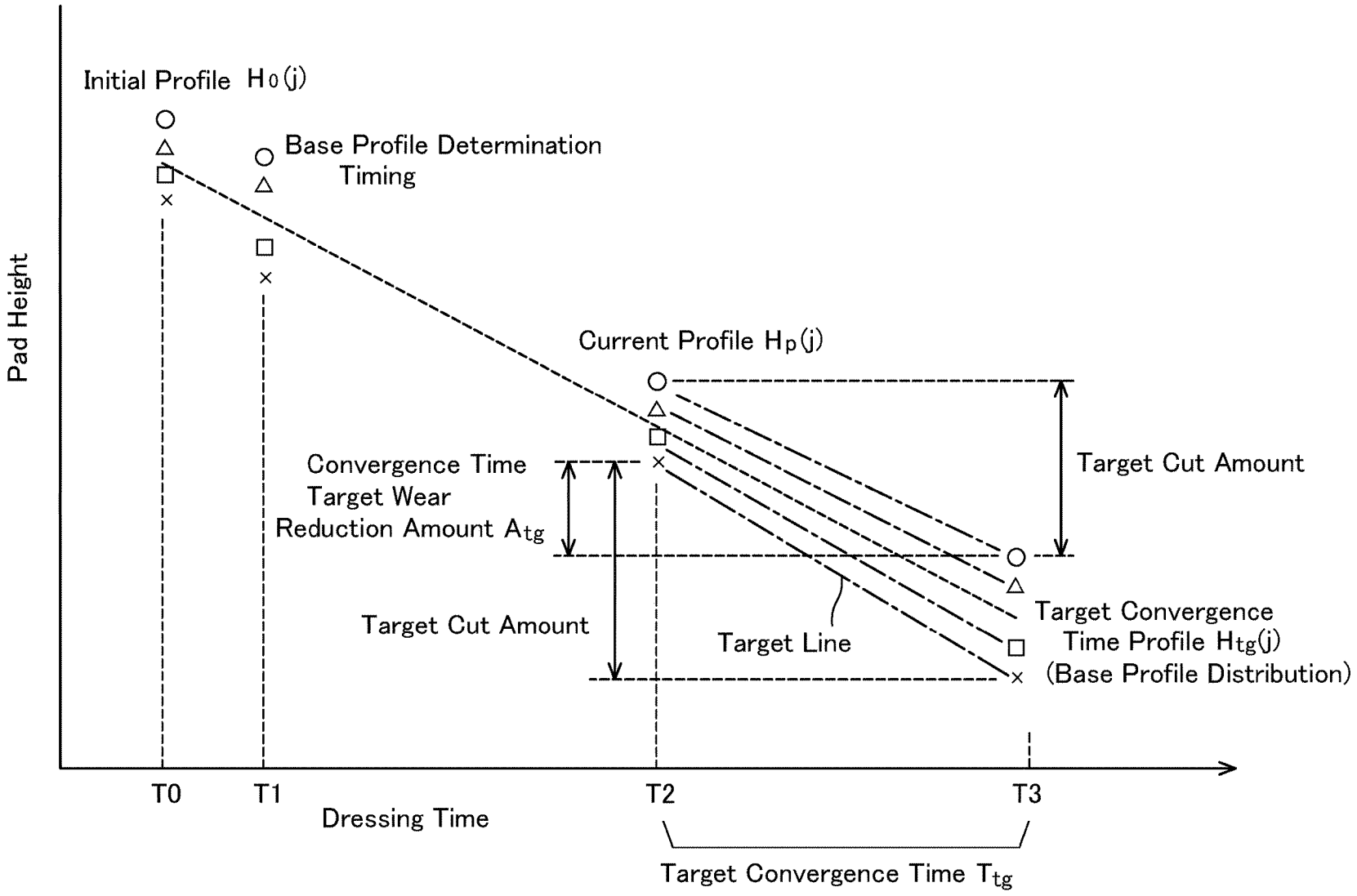
FIG. 6 is an explanatory diagram illustrating an example of profile transition of a polishing pad height in each monitoring area.

The base profile calculation section 42 calculates a target profile (base profile) of the pad height at convergence (see FIG. 6). The base profile is used to calculate a target amount of cut used in the moving speed calculation section 45 which will be described later. The base profile may be calculated based on the height distribution (Diff(j)) of the polishing pad in a pad initial state and the measured pad height or may be given as a set value. When the base profile is not set, it is possible to calculate a target cut amount where the shape of the polishing pad becomes flat.

The base of the target cut amount is calculated according to the following expression using a pad height profile $H_p(j)$ [j=1, 2, . . . , m] indicating a pad height for each monitoring area at a current point in time and a convergence time target wear amount $A_{tg}$ separately set by a parameter setting section 49 which will be described later.

$$\min\{H_p(j)\}-A_{tg}$$

Furthermore, the target cut amount in each monitoring area can be calculated in consideration of the aforementioned base profile by the following expression:

$$\min\{H_p(j)\}-A_{tg}+\mathrm{Diff}(j)$$

The cut rate calculation section 43 calculates a cut rate of the dresser in each monitoring area. For example, the cut rate may also be calculated from tilt of a variation in the pad height in each monitoring area.

The evaluation index creation section 44 is intended to optimize the moving speed of the dresser in each scanning area by calculating an optimum staying time (swing time) in a scanning area and making a correction using an evaluation index which will be described later. The evaluation index is 1) a deviation from the target cut amount, 2) a deviation from the staying time according to a reference recipe and 3) an index based on a speed difference between neighboring scanning areas, and is a function of staying time $T=[w_1/v_1, w_2/v_2, \ldots, w_n/v_n]$ in each scanning area. The moving speed of the dresser is optimized by defining the staying time T in each scanning area so that the evaluation index becomes a minimum.

1) Deviation from Target Cut Amount

When the target cut amount of the dresser is assumed to be $U_0=[U_{01}, U_{02}, \ldots, U_{0m}]$, a deviation from the target cut amount is calculated by calculating the square value ($|U-U_0|^2$) of the difference from the aforementioned pad wear amount U (=ST) in each monitoring area. Note that the target profile for determining the target cut amount can be determined at any timing after starting to use the polishing pad or may be determined based on a manually set value.

2) Deviation from Staying Time According to Reference Recipe

Figure 7:
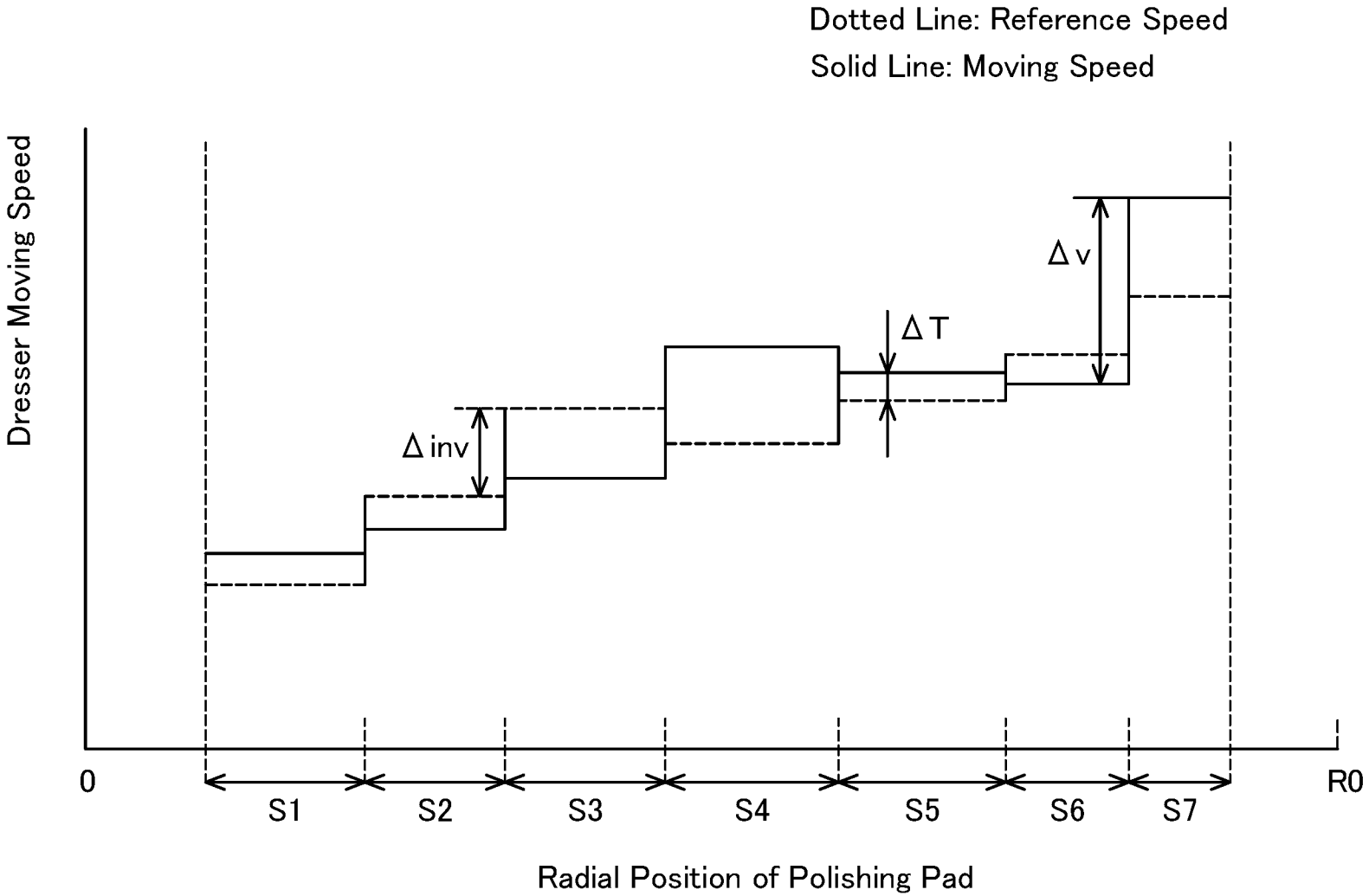
FIG. 7 is an explanatory diagram illustrating an example of a dresser moving speed and a reference value in each scanning area.

As shown in FIG. 7, a deviation from the staying time according to a reference recipe can be calculated by calculating the square value ($\Delta T^2=|T-T_0|^2$) of a difference ($\Delta T$) between the moving speed of the dresser (reference speed (reference staying time $T_0$)) based on the reference recipe set in each scanning area and the moving speed of the dresser (staying time T of the dresser) in each scanning area. Here, the reference speed is a moving speed at which a flat cut rate is expected to be obtained in each scanning area and is a value obtained by experiment or simulation in advance. When the reference speed is obtained by simulation, the reference speed can be calculated by assuming that a scratch distance (staying time) of the dresser is proportional to a cut amount of the polishing pad. Note that the reference speed may be updated as appropriate according to the actual cut rate when the same polishing pad is in use.

3) Speed Difference Between Neighboring Scanning Areas

The polishing apparatus according to the present embodiment further suppresses influences accompanying a drastic change of the moving speed on the polishing apparatus by reducing a speed difference between neighboring scanning areas. That is, it is possible to calculate an index of the speed difference between neighboring scanning areas by calculating the square value ($|\Delta V_{inv}|^2$) of a speed difference between neighboring scanning areas. Here, as shown in FIG. 7, as a speed difference between the scanning areas, either a difference ($A_{inv}$) in the reference speed or a moving speed ($\Delta_v$) of the dresser can be used. Note that since the width of the scanning area has a fixed value, the index of the speed difference depends on the staying time of the dresser in each scanning area.

The evaluation index creation section 44 defines an evaluation index J shown in the following equation based on these three indices.

$$J=\gamma|U-U_0|^2+\lambda|T-T_0|^2+\eta|\Delta V_{inv}|^2$$

Here, a first term, a second term and a third term on the right side of the evaluation index J are indices resulting from the deviation from the target cut amount, the deviation from the staying time according to a reference recipe and the speed difference between neighboring scanning areas, and all the terms depend on the staying time T of the dresser in each scanning area. In the above evaluation index J, $\gamma$, $\lambda$ and $\eta$ are predetermined weighting values and set by the parameter setting section 49.

The moving speed calculation section 45 performs optimization calculation such that the value of the evaluation index J becomes a minimum value, calculates the staying time T of the dresser in each scanning area and corrects the moving speed of the dresser. As an optimization calculation technique, a quadratic programming method can be used, but convergence calculation using simulation or PID control may also be used.

Figure 8:
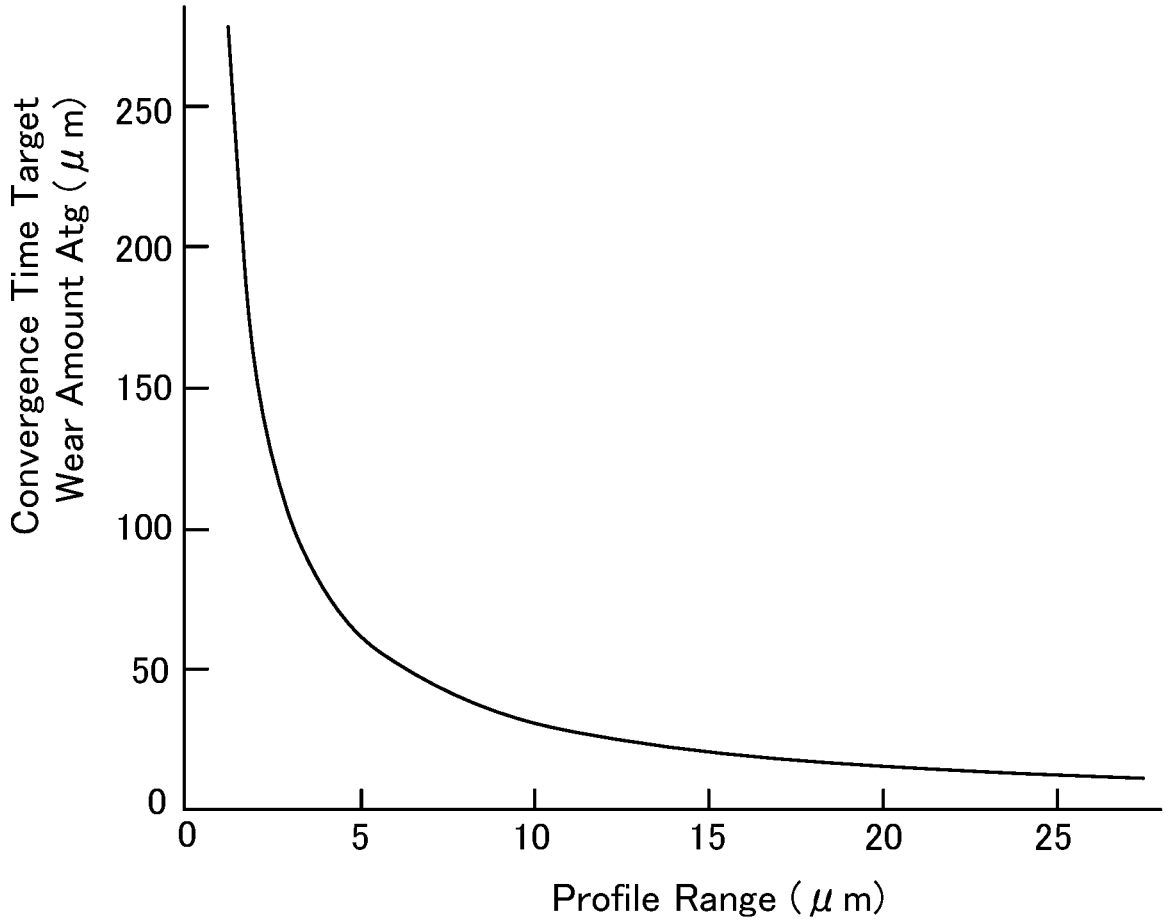
FIG. 8 is a graph illustrating an example of a relationship between a profile range and a convergence time target wear amount $A_{tg}$.

The present embodiment is configured such that the parameter setting section 49 changes the aforementioned convergence time target wear amount $A_{tg}$ as appropriate when the same polishing pad is in use. FIG. 8 is a graph illustrating a relationship between the convergence time target wear amount $A_{tg}$ and a profile range according to the present embodiment. The profile range is a width (difference between a maximum value and a minimum value) of a profile at a certain point in time. In the present embodiment, the profile range and the convergence time target wear amount $A_{tg}$ are associated with each other so as to have an inversely proportional relationship, but without being limited to this, the present invention can use an arbitrary function such that the convergence time target wear amount $A_{tg}$ decreases when the profile range increases.

Figure 9:
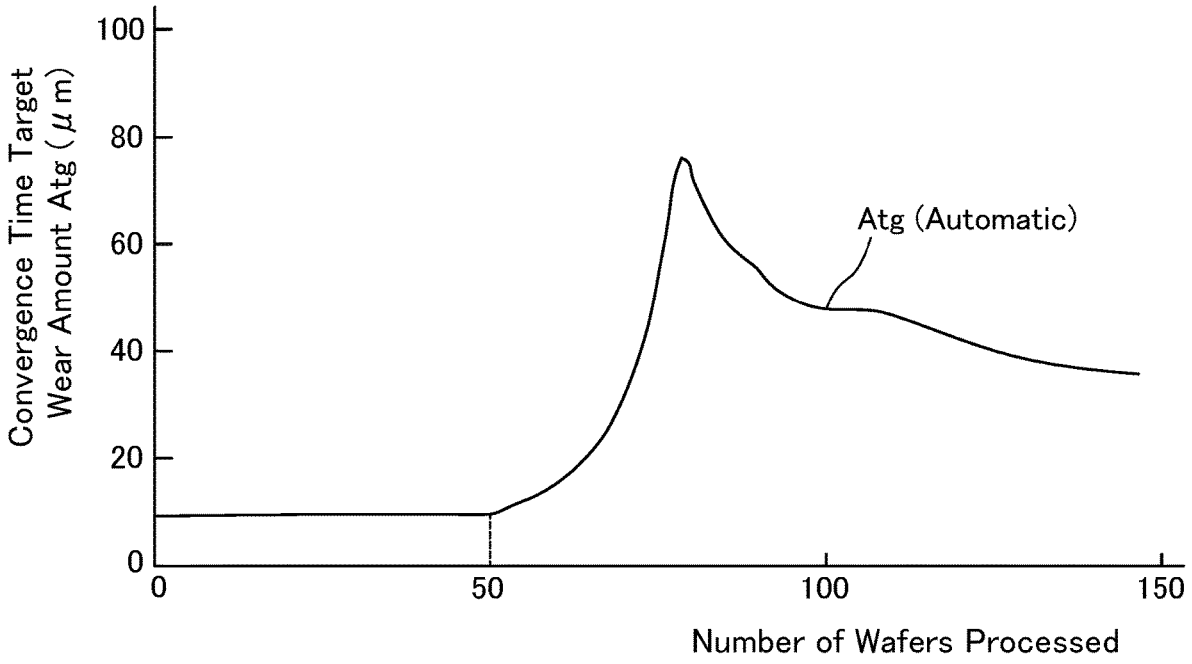
FIG. 9 is a graph illustrating an example of a change of the convergence time target wear amount $A_{tg}$.

The parameter setting section 49 is provided with a table corresponding to the relationship in FIG. 8 and sets the convergence time target wear amount $A_{tg}$ based on the measured values of the profile range. FIG. 9 is a graph illustrating how the convergence time target wear amount $A_{tg}$ changes and a setting is made such that control of the convergence time target wear amount $A_{tg}$ is started when the number of wafers processed (the number of wafers polished) reaches 50, but the number of wafers polished to start such control can be determined as appropriate. In the example in FIG. 9, the value of the convergence time target wear amount $A_{tg}$ changes in such a way that the value of $A_{tg}$ gradually increases after control of $A_{tg}$ is started and gradually decreases after $A_{tg}$ reaches a peak.

Figure 10:
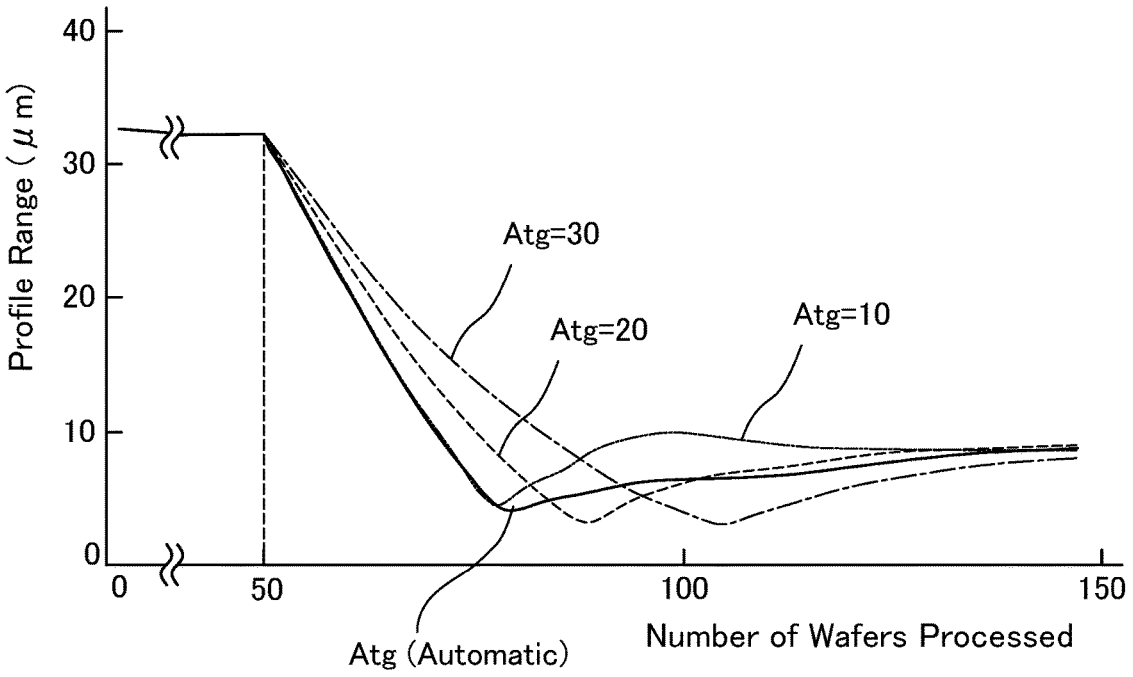
FIG. 10 is a graph illustrating an example of a change of the profile range when the convergence time target wear amount $A_{tg}$ is changed.

FIG. 10 is a graph illustrating a change of the profile range when $A_{tg}$ is changed ($A_{tg}$ automatic) in comparison with a case where $A_{tg}$ is set to a fixed value (10 μm, 20 μm, 30 μm). The graph shows that performing control so as to change $A_{tg}$ causes the profile range to converge more quickly (convergence takes place with fewer wafers) without overshooting compared to a case where $A_{tg}$ is set to a fixed value.

Note that when calculating the moving speed of the dresser, it is preferable to ensure that the total dress time falls within a predetermined value. Here, the total dress time refers to a moving time of the entire swing section (scanning areas S1 to S7 in the present embodiment) by the dresser. When the total dress time (time required for dressing) increases, other steps such as a wafer polishing step or a transporting step may be affected, and so it is preferable to correct the moving speed in each scanning area as appropriate in order to prevent the value from exceeding the predetermined value. Since there are mechanical constraints on the apparatus, it is preferable to set the moving speed of the dresser such that the maximum (and minimum) moving speed of the dresser and the ratio of the maximum speed (minimum speed) to the initial speed fall within a set value range.

IT is noted that when appropriate dress conditions are unknown in a combination of a new dresser and the polishing pad or when a reference speed of the dresser (reference staying time $T_0$) is not determined as in a case immediately after replacement of the dresser or the polishing pad, the moving speed calculation section 45 may determine an evaluation index J (shown below) using only the condition of deviation from the target cut amount and perform optimization (initial setting) of the moving speed of the dresser in each scanning area.

$$J=|U-U_0|^2$$

The setting input section 46 is an input device such as a keyboard or a mouse and configured to input various parameters such as a value of each component of the dress model matrix S, a setting of a constraint condition, a cut rate update cycle or a moving speed update cycle. The memory 47 stores various types of data such as data of a program for operating each component constituting the dressing monitoring apparatus 35, value of each component of the dress model matrix S, target profile, weighted value of the evaluation index J and set value of the moving speed of the dresser.

Figure 11:
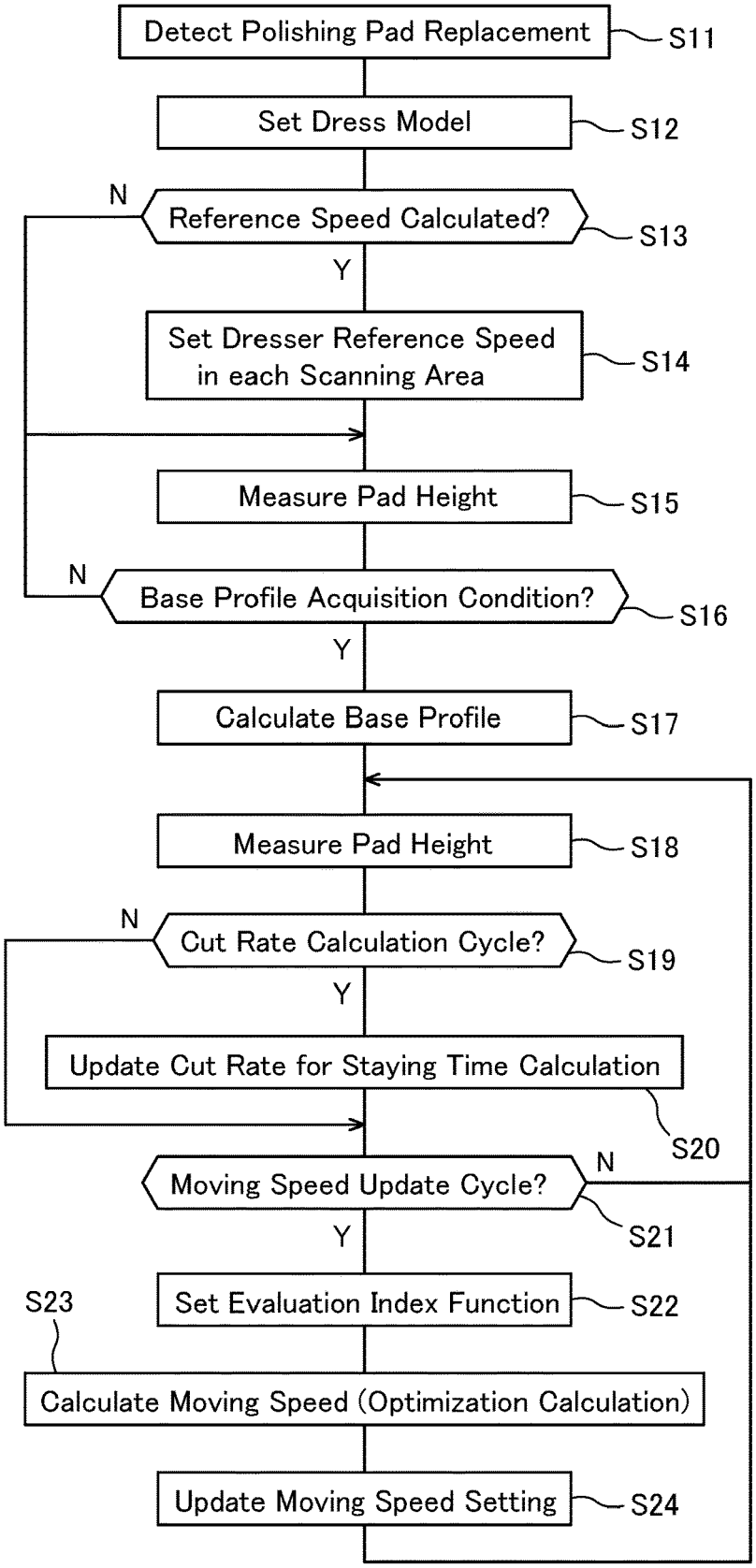
FIG. 11 is a flowchart illustrating an example of a procedure for adjusting the moving speed of the dresser.

FIG. 11 is a flowchart illustrating a processing procedure for controlling the moving speed of the dresser. Upon detecting that the polishing pad 11 is replaced (step S11), the dress model setting section 41 derives the dress model matrix S by taking into account parameters such as cut rate model, dresser diameter or scanning speed control (step S12). Note that in the case of the pad of the same type, the dress model matrix can be continuously used.

Next, it is determined whether or not to calculate reference speed of the dresser (whether or not the setting input section 46 inputs an instruction for calculating reference speed) (step S13). When calculating the reference speed, the moving speed calculation section 45 sets the moving speed (staying time T) of the dresser in each scanning area such that the next evaluation index J becomes a minimum value based on the target cut amount $U_0$ of the dresser and the pad wear amount U in each monitoring area (step S14). The calculated reference speed may be set as an initial value of the moving speed.

$$J=|U-U_0|^2$$

After that, when dressing processing on the polishing pad 11 is performed accompanying the polishing processing on the wafer W, the pad height sensor 32 measures the height (pad height) of the polishing surface 11*a* (step S15). It is determined whether or not the base profile acquisition condition (e.g., polishing of a predetermined number of wafers W) is satisfied (step S16) and if the condition is satisfied, the base profile calculation section 42 calculates a target profile (base profile) of the pad height in convergence (step S17).

After that, when dressing processing on the polishing pad 11 is performed accompanying the polishing processing on the wafer W, the pad height sensor 32 measures the height (pad height) of the polishing surface 11*a* (step S18). It is determined whether or not a predetermined cut rate calculation cycle (e.g., polishing on a predetermined number of wafers W) is reached (step S19) and if the predetermined cut rate calculation cycle is reached, the cut rate update section 45 calculates a cut rate of the dresser in each scanning area (step S20).

Furthermore, it is determined whether or not the moving speed update cycle of the dresser (e.g., polishing of a predetermined number of wafers W) is reached (step S21), and when the moving speed update cycle of the dresser is reached, the parameter setting section 49 sets the convergence time target wear amount $A_{tg}$ from the value of the measured profile range (step S22).

The moving speed calculation section 45 determines an evaluation index J using the value of the set convergence time target wear amount $A_{tg}$, calculates a staying time of the dresser corresponding to the minimum evaluation index J, and thereby optimizes the dresser moving speed in each scanning area (step S23). The optimized value of the moving speed is set and the moving speed of the dresser is updated (step S24). Thereafter, the flow returns to step S18 and the above-described process is repeated until the polishing pad 11 is replaced.

The above-described embodiment is configured such that the parameter setting section 49 changes the convergence time target wear amount $A_{tg}$, but without being limited to this, the present invention may cause the weighting factor of the evaluation index J to fluctuate.

Figure 12:
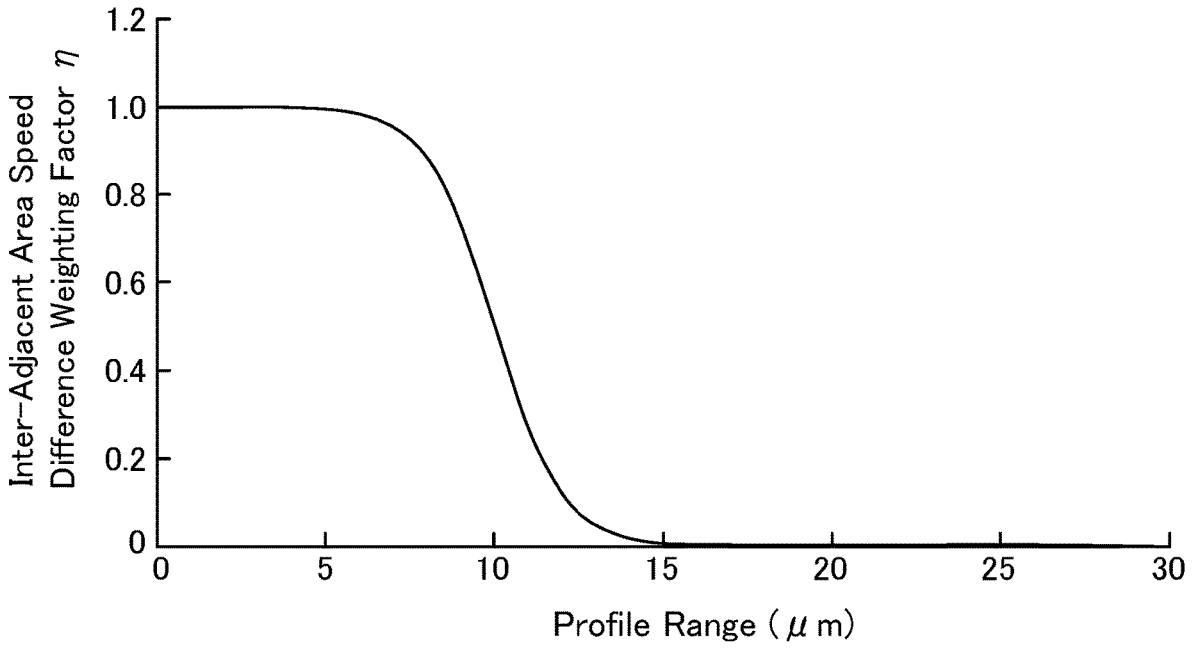
FIG. 12 is a graph illustrating an example of a change of an inter-adjacent-area speed difference weighting factor $\eta$.

FIG. 12 illustrates an example in which an inter-adjacent-area speed difference weighting factor η among weighting parameters (coefficients) of the evaluation index J is changed in accordance with the profile range. In this example, the value of the weighting factor η is determined so that the value of the profile range drastically changes in the vicinity of a reference value (e.g., 10 μm), and, for example, the following sigmoid function can be used.

$$\eta = A \times \text{sigmoid}(-(\text{Range} - \textit{TargetRange}))$$

$$\text{sigmoid}(x) = \frac{1}{1 + e^{-ax}}$$

In the above-described equation, "A" and "a" are predetermined parameters, "Range" is a profile range, "TargetRange" is a reference value, and in the example in FIG. 12, A=1, a=1 and TargetRange=10. The parameter setting section 49 sets the weighting factor η in accordance with the profile range obtained.

Figure 13:
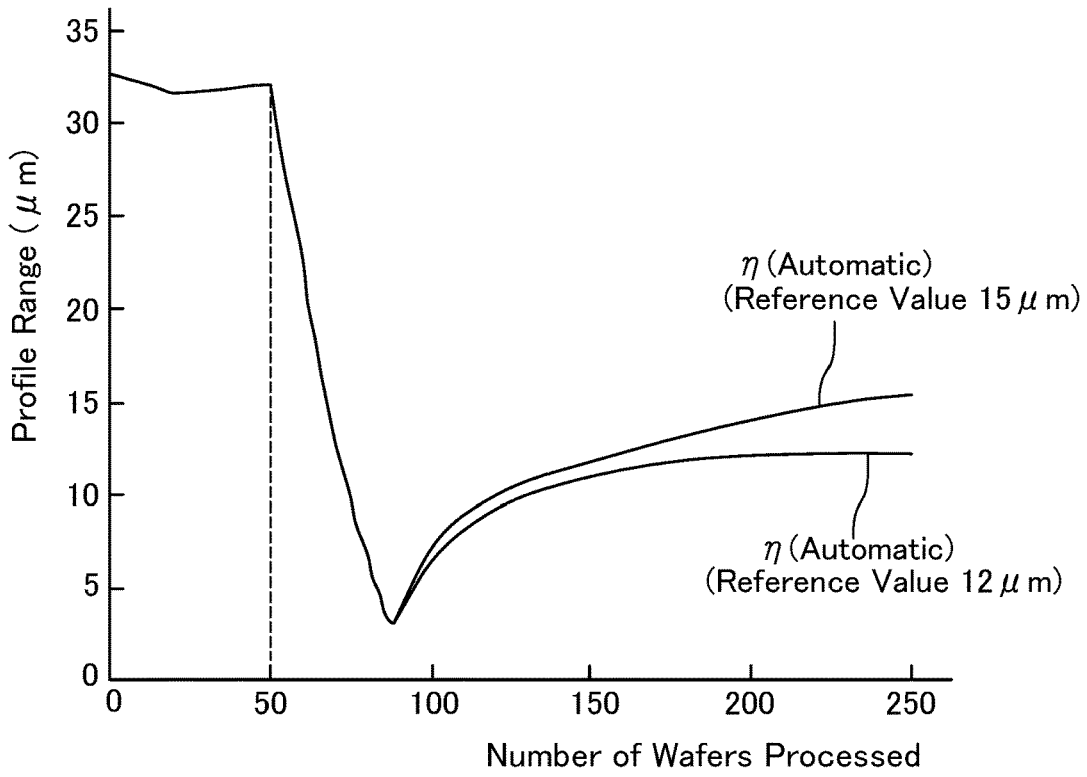
FIG. 13 is a graph illustrating an example of a change of the profile range when the inter-adjacent-area speed difference weighting factor $\eta$ is changed.
Figure 14:
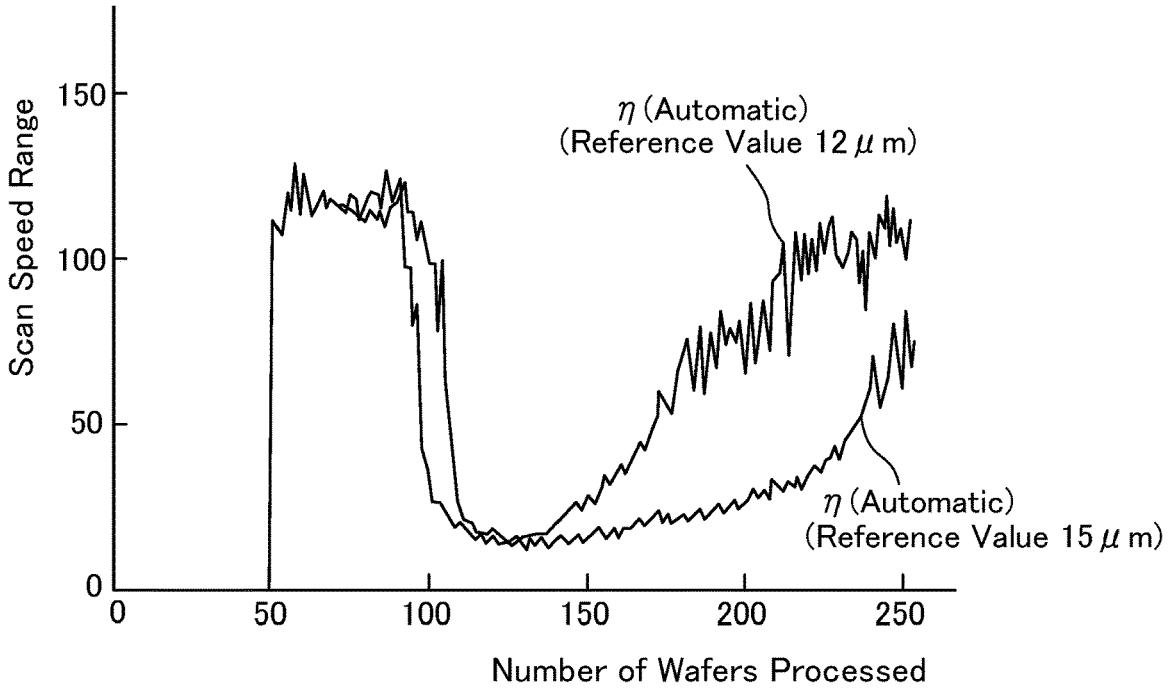
FIG. 14 is a graph illustrating an example of a change of a scanning speed range when an inter-adjacent-area speed difference weighting factor $\eta$ is changed.

FIG. 13 is a graph illustrating a change of the profile range when the value of the weighting factor η is automatically changed based on FIG. 12 and FIG. 14 is a graph illustrating a change of a scan speed range. Here, the "scan speed range" means a difference between a maximum value and a minimum value of the scan speed in each area during wafer processing. Note that control of the weighting factor η is set to start when the number of wafers polished reaches 50 as in the case of the control example of the convergence time target wear amount $A_{tg}$.

The graph in FIG. 13 shows that the profile range converges to a predetermined value (reference value Range) as the number of wafers processed increases. The graph in FIG. 14 shows a situation in which the scan speed range drastically decreases in the vicinity of a place where the number of wafers processed is 100 (50 wafers since the control starts) and then the number of wafers processed gradually increases.

Figure 15:
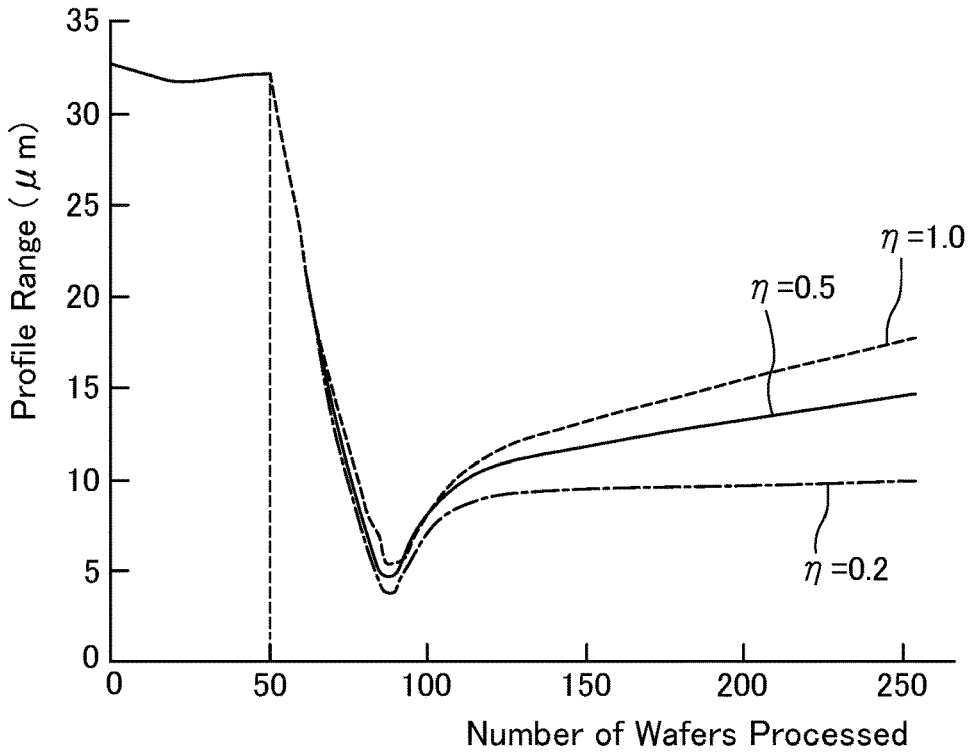
FIG. 15 is a graph illustrating an example of a change of the profile range when the inter-adjacent-area speed difference weighting factor $\eta$ is set to a fixed value.
Figure 16:
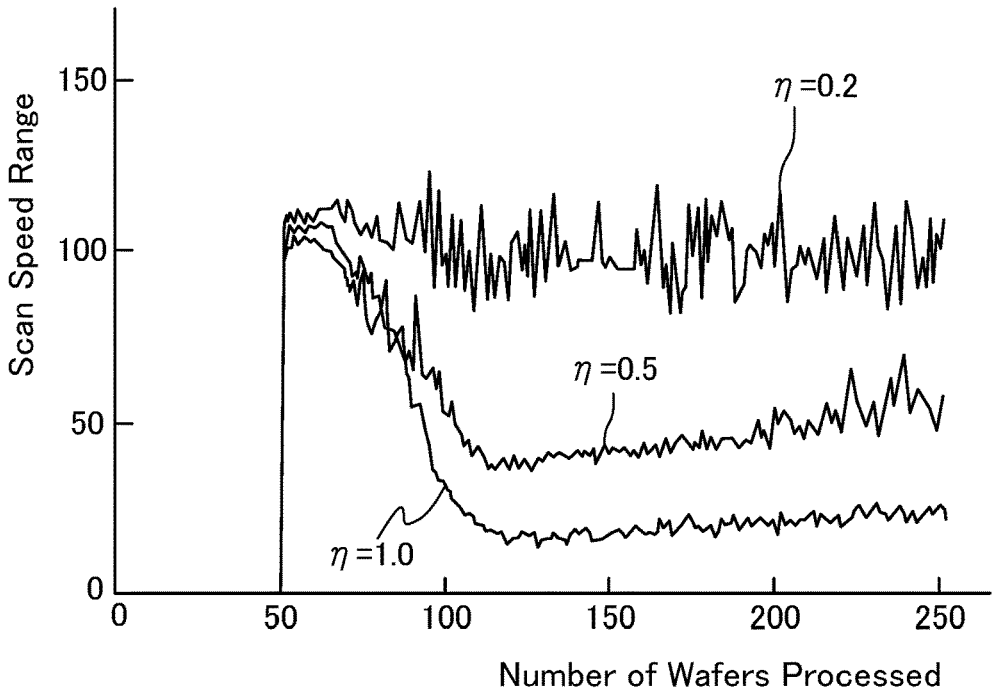
FIG. 16 is a graph illustrating an example of a change of a scanning speed range when the inter-adjacent-area speed difference weighting factor $\eta$ is set to a fixed value.

On the other hand, FIG. 15 and FIG. 16 are graphs illustrating changes of the profile range and the scan speed range respectively when the weighting factor η is determined as a fixed value (0.2, 0.5, 1.0). The graph in FIG. 15 shows that when the weighting factor η is increased, the profile range increases as the number of wafers processed increases. The graph in FIG. 16 shows that when the weighting factor η is lowered, the scan speed range increases as the number of wafers processed increases. Thus, when the weighting factor η is set to a fixed value, a tradeoff is generated between the profile range and the scan speed range. Furthermore, wear resistance of the pad differs depending on the pad or dresser used, and so it is difficult to determine the weighting factor η to an appropriate value.

On the contrary, by adopting a configuration in which the weighting factor η is automatically changed, it is possible to perform control such that the profile range is brought closer to a predetermined value (reference value) while suppressing the scan speed range. By changing the weighting factor of the evaluation index J, it is possible to adjust indices to be emphasized as appropriate in accordance with an operation situation of the apparatus without depending on characteristics of the polishing pad or the dresser.

The above-described embodiment has been described on the assumption that the height of the polishing pad is lowered accompanying the polishing processing on the wafer W, but in the case where the processing on the wafer W is not performed for a while, the polishing pad may contain water and swell, and an apparent height of the polishing pad may increase. The amount of swelling of the polishing pad varies depending on the type of the polishing pad or a state of using the apparatus, but when the height of the polishing pad varies due to swelling, the cut rate to be used to calculate the evaluation index J becomes a negative value, and as a result, the moving speed of the dresser cannot be calculated or the calculated value may become an abnormal value, and in such a case, the performance of the polishing apparatus may be affected.

Figure 17:
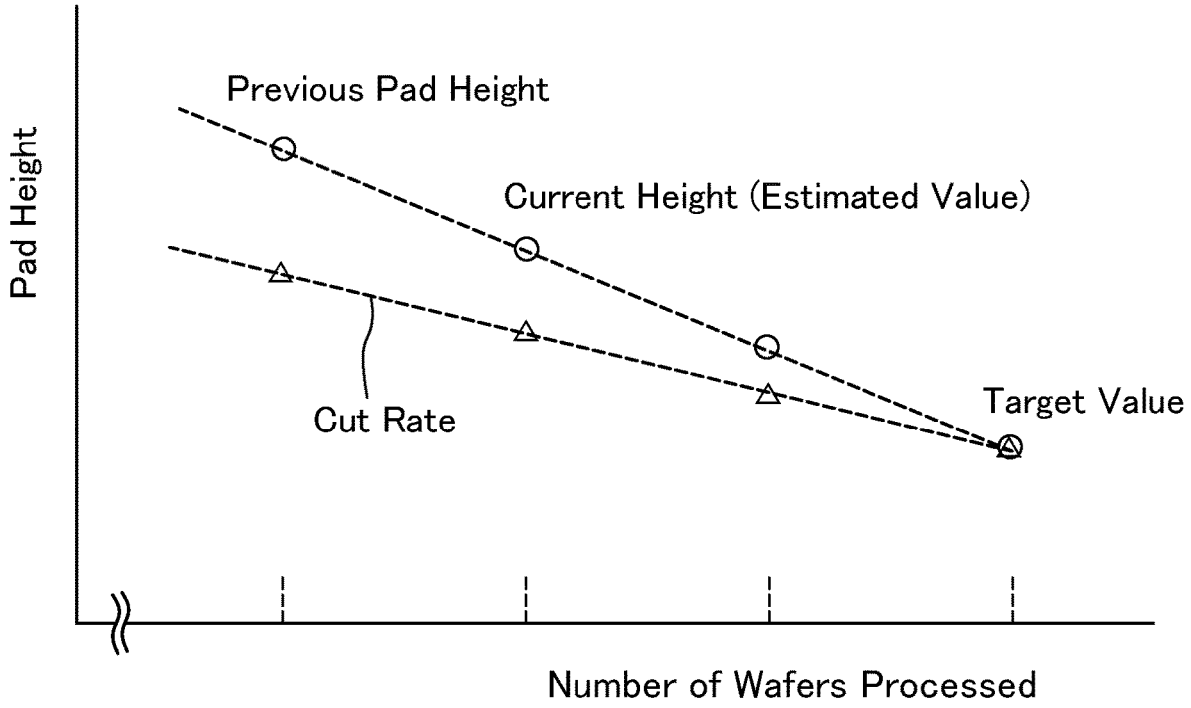
FIG. 17 is an explanatory diagram illustrating an example of a method for estimating a polishing pad height.

Therefore, as shown in FIG. 17, assuming that the (actual) cut rate of the polishing pad does not drastically change, the cut rate calculation section 43 may hold a calculated value of the latest (immediately preceding) cut rate and estimate the current pad height using the cut rate value and the previous value of the pad height. Thus, by calculating the moving speed of the dresser and the cut rate asynchronously, it is possible to avoid a situation in which the cut rate cannot be accurately calculated.

It is noted that the cut rate calculation interval may be preferably determined by a combination of the polishing pad and the dresser. Alternatively, as the cut rate calculation method, it may be possible to select any one of a method of calculating the cut rate from the initial pad height and the current height (measured value) of the polishing pad and a method of calculating the cut rate from the pad height when the previous cut rate is calculated and the current height of the polishing pad.

Furthermore, the monitoring target is not limited to the height of the polishing pad, but surface roughness of the polishing pad may be measured and the moving speed may be calculated such that the surface roughness may be made uniform.

Second Embodiment

Hereinafter, another embodiment of the present invention will be described. Note that the same members as those described in the above first embodiment are assigned the same reference numerals and detailed description thereof will be omitted.

Figure 18:
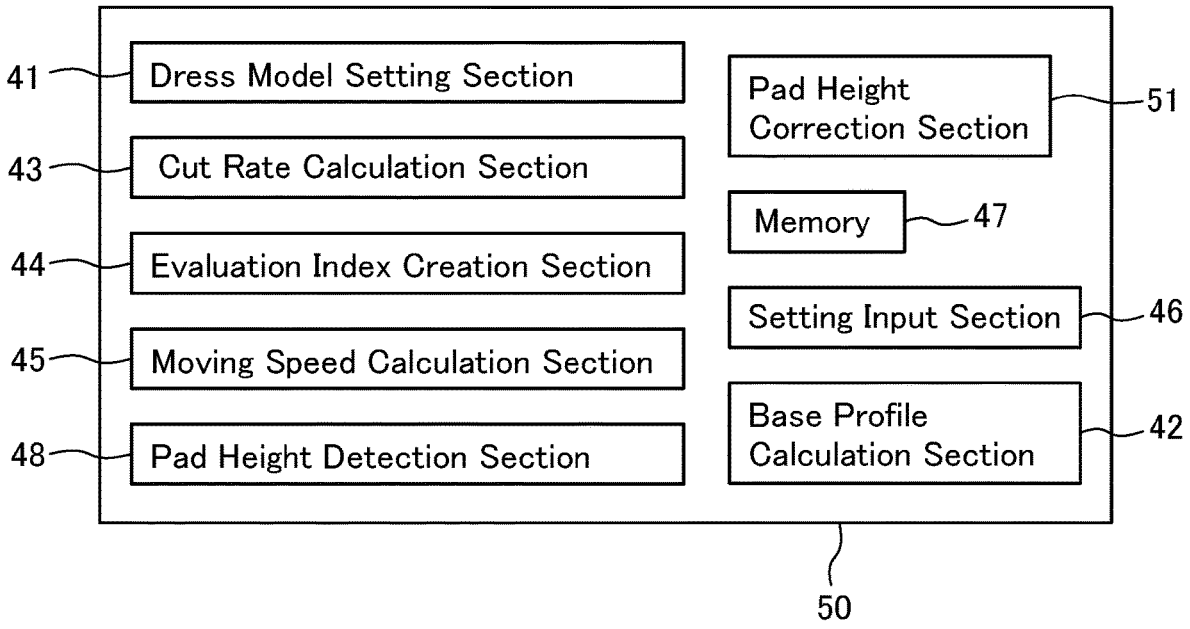
FIG. 18 is a block diagram illustrating an example of a configuration of a dresser monitoring apparatus.

As shown in FIG. 18, the dressing monitoring apparatus 50 is provided with a dress model setting section 41, a base profile calculation section 42, a cut rate calculation section 43, an evaluation index creation section 44, a moving speed calculation section 45, a setting input section 46, a memory 47, a pad height detection section 48 and a pad height correction section 51, and acquires a profile of the polishing pad 11 and sets a moving speed of the dresser 23 to an optimum value in the scanning area at predetermined timing.

The pad height detection section 48 detects a pad height in each monitoring area by associating height data of the polishing pad continuously measured by the pad height sensor 32 with measured coordinate data on the polishing pad. More specifically, the pad height detection section 48 calculates a value of the pad height in each monitoring area by performing averaging processing (spatial averaging) on the measured height data of the polishing pad (height data in the radius direction of the polishing pad) using a plurality of adjacent pieces of height data and then averaging the height data after moving averaging for each divided monitoring area. After that, the pad height detection section 48 generates height data after the moving averaging by performing averaging using height data (after averaging processing) obtained during wafer polishing processing on a plurality of immediately preceding wafers (e.g., 5 wafers) for each monitoring area. Thus, influences of drastic fluctuation or variation in the measured values are suppressed by taking moving average of the measured values of the polishing pad height through a plurality of immediately preceding measurements.

In the case where processing on a wafer W is not performed for a while, if the height of the polishing pad measured and detected by the pad height detection section 48 changes drastically, the pad height correction section 51 determines that swelling or contraction of the polishing pad has occurred and performs correction processing of the height of the polishing pad. Details of the correction processing will be described later.

The evaluation index creation section 44 defines an evaluation index J expressed by the following equation based on the following three indices described in the above-described first embodiment (a square value ($|U-U_0|^2$) of a difference from a pad wear amount U (=ST) in each monitoring area, a square value ($\Delta T^2=|T-T_0|^2$) of a difference ($\Delta T$) from a moving speed (dresser staying time T) of the dresser in each scanning area and a square value ($|\Delta V_{inv}|^2$)) of a difference in speed between adjacent scanning areas).

$$J=\gamma|U-U_0|^2+\lambda|T-T_0|^2+|\Delta V_{inv}|^2$$

where, the first term, second term and third term of the right side of the evaluation index J are a deviation from a target cut amount, a deviation from the staying time in a reference recipe and an index caused by a speed difference between adjacent scanning areas respectively and all the terms depend on a staying time T of the dresser in each scanning area.

The moving speed calculation section 45 performs optimization calculation such that the value of the evaluation index J takes a minimum value, thereby calculates the staying time T of the dresser in each scanning area and corrects the moving speed of the dresser. As a technique for optimization calculation, a quadratic programming can be used, but convergence calculation using a simulation or PID control may also be used.

In the above-described evaluation index J, $\gamma$, $\lambda$ and $\eta$ are predetermined weighting values and these can be changed as appropriate while the same polishing pad is in use. By changing these weighting values, it is possible to adjust indices to be emphasized as appropriate in accordance with characteristics of the polishing pad and the dresser or an operating situation of the apparatus.

Here, when processing on the wafer W is not performed for a while, if the polishing pad swells with moisture, the measured value of the height of the polishing pad may increase compared to the last measurement time. On the contrary, when processing on the wafer W is not performed for a while, if the polishing pad is contracted, the measured value of the height of the polishing pad may drastically decrease.

When the measured value of the height of the polishing pad discontinuously fluctuates because the polishing pad is not used for a long period of time, the cut rate that should be used to calculate the evaluation index J changes drastically (or the cut rate becomes a negative value), and as a result, it may be impossible to calculate the moving speed of the dresser or the calculated value may become abnormal. The performance of the polishing apparatus may be affected in such a case.

For this reason, the polishing apparatus of the present embodiment does not measure the height of the polishing pad for a time exceeding a reference value $\Delta T_{TH}$ and when the change of the measured value exceeds a threshold $\Delta H_{TH}$, the polishing apparatus determines that an abnormality (swelling or contraction) has occurred in the polishing pad, corrects the measured value of the polishing pad height including the past measured values, and thereby reduces discontinuous changes of the cut rate.

Figure 19:
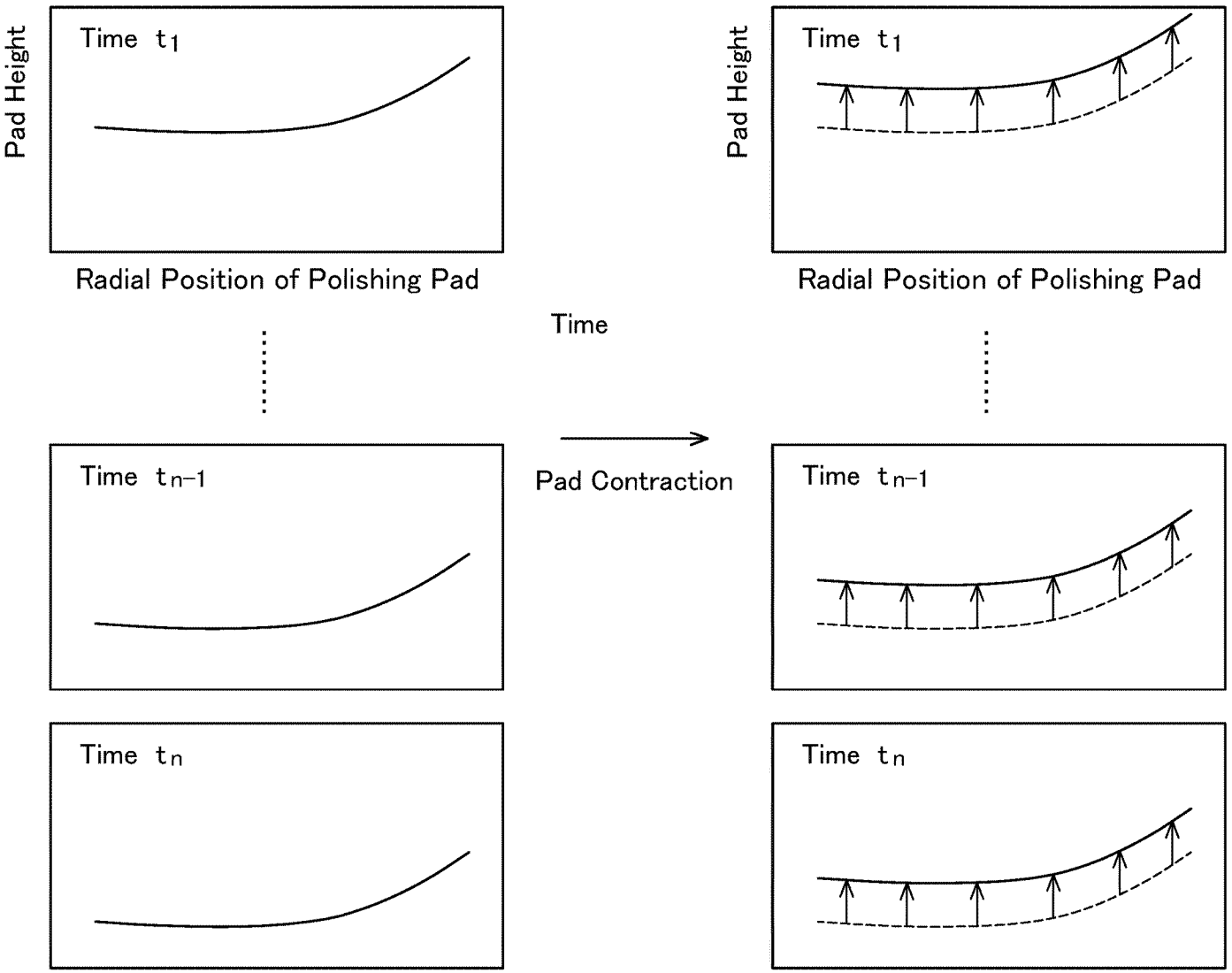
FIG. 19 is a diagram for describing processing of correcting a pad height measured value when swelling occurs in the polishing pad.

FIG. 19 is an explanatory diagram illustrating how height data of the polishing pad is corrected with the drawings on the left side illustrating when no swelling has occurred in the polishing pad and the drawings on the right side illustrating when swelling has occurred. When no swelling has occurred, the pad height correction section 51 makes no correction and values measured by the pad height detection section 48 is output as height data of the polishing pad. A cut rate is calculated using the height data of the polishing pad for a past certain period (e.g., time t1 to tn corresponding to a period during which the amount of wear of the polishing pad used to calculate the cut rate becomes a set value or more).

On the other hand, when it is detected that swelling has occurred, the pad height correction section 51 corrects the measured value of the polishing pad height by adding a correction value which will be described later to the data of the polishing pad height for a past certain period (time t1 to tn). On the other hand, when it is detected that contraction has occurred in the polishing pad, the pad height correction section 51 corrects the measured value of the polishing pad height by subtracting a correction value which will be described later from the data of the polishing pad height for a past certain period (time t1 to tn). Such corrections make it possible to stably control the pad height profile even when a discontinuous change occurs in the measured value of the polishing pad height without affecting calculations of the cut rate.

Figure 20:
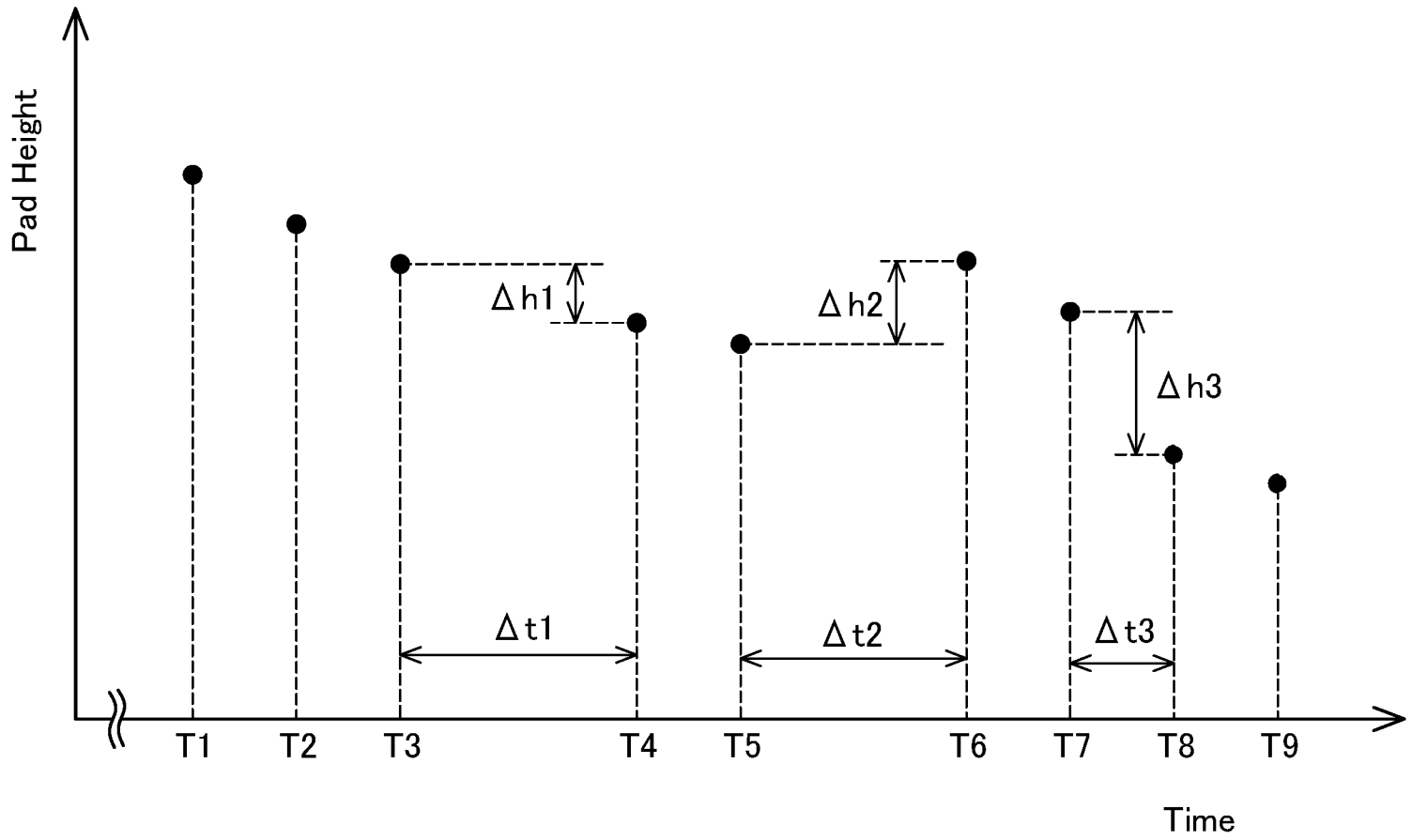
FIG. 20 is a graph illustrating an example of a time change of measured values of the polishing pad height.

FIG. 20 illustrates an example of a time transition of the polishing pad height measured by the pad height detection section 48. FIG. 20 shows that the measured value of the pad height gradually decreases for a period of time T1 to T3 and shows how the height of the polishing pad decreases in accordance with wafer polishing. Here, intervals between times T1 and T2, and between times T2 and T3 are smaller than the reference value $\Delta T_{TH}$ respectively and so the pad height is not corrected. Note that the value of the reference value $\Delta T_{TH}$ can be determined as appropriate so as to be greater than a time interval of measurement of the polishing pad height when wafer polishing is performed continuously.

In FIG. 20, when an interval $\Delta_{t1}$ between times T3 and T4 is greater than the aforementioned reference value $\Delta T_{TH}$ (that is, when an idle time of wafer polishing is long for such a reason that the apparatus is stopped), the pad height correction section 51 determines whether or not a change (reduced value) $A_{h1}$ of the measured value of the polishing pad height exceeds the threshold $\Delta H_{TH}$, and determines, when the change exceeds the threshold $\Delta H_{TH}$, that an abnormality (contraction) has occurred in the polishing pad and subtracts $A_{h1}$ as a correction value from the data of the polishing pad height.

In FIG. 20, when the interval $\Delta_{t2}$ between times T5 and T6 is greater than the aforementioned reference value $\Delta T_{TH}$, the pad height correction section 51 determines whether or not a change (increased value)$\Delta_{h2}$ of the measured value of the polishing pad height exceeds the threshold $\Delta H_{TH}$, and determines, when the change exceeds the threshold $\Delta H_{TH}$, that an abnormality (swelling) has occurred in the polishing pad and adds $\Delta_{h2}$ to the data of the polishing pad height as a correction value.

Thus, it is possible to detect swelling or contraction of the polishing pad based on both the interval between detection times of the polishing pad height and a difference between the measured values, correct measured values including the past ones, and thereby appropriately correct measured values of the polishing pad and discontinuous changes of the cut rate.

Note that an abnormality (swelling or contraction) in the polishing pad may be determined using any one of the measured values of the pad height in the diameter direction of the polishing pad as a reference, and in this case, any one of measured values exceeding the threshold $\Delta H_{TH}$ is added (or subtracted) as a correction value. Alternatively, an average value of the measured values of the pad height in the diameter direction of the polishing pad may be used as a reference for determination, and in this case, when the average value exceeds the threshold $\Delta H_{TH}$, a configuration can be adopted in which the average value is added (or subtracted) as a correction value. Furthermore, regarding the threshold $\Delta H_{TH}$, different thresholds may be set for swelling and contraction.

When an abnormality (swelling or contraction) occurs in the polishing pad, the pad height correction section 51 determines whether or not a change of the measured value of the polishing pad height has exceeded the threshold $\Delta H_{TH}$ regardless of whether or not the measurement time interval of the pad height exceeds the reference value $\Delta T_{TH}$ (whether or not an idle time of wafer polishing is long). In the example in FIG. 20, even when the interval $\Delta_{t3}$ between times T7 and T8 is the reference value $\Delta T_{TH}$ or less, if the change $\Delta_{h3}$ of the measured value of the polishing pad height exceeds the threshold $\Delta H_{TH}$, the polishing pad height is corrected. On the other hand, when the change $\Delta_{h3}$ of the measured value of the polishing pad height does not exceed the threshold $\Delta H_{TH}$, the polishing pad height is not corrected. It is thereby possible to perform correction processing finely after an abnormality (swelling or contraction) occurs in the polishing pad. Note that when a predetermined time elapses after the last abnormality (swelling or contraction) of the polishing pad is detected (that is, when a situation in which the change $\Delta_{h3}$ of the measured value of the polishing pad height does not exceed the threshold $\Delta H_{TH}$ continues for a predetermined period), it may also be possible to determine an abnormality (swelling or contraction) of the polishing pad including a determination on whether or not the measurement time interval of the pad height exceeds the reference value $\Delta T_{TH}$.

Figure 21:
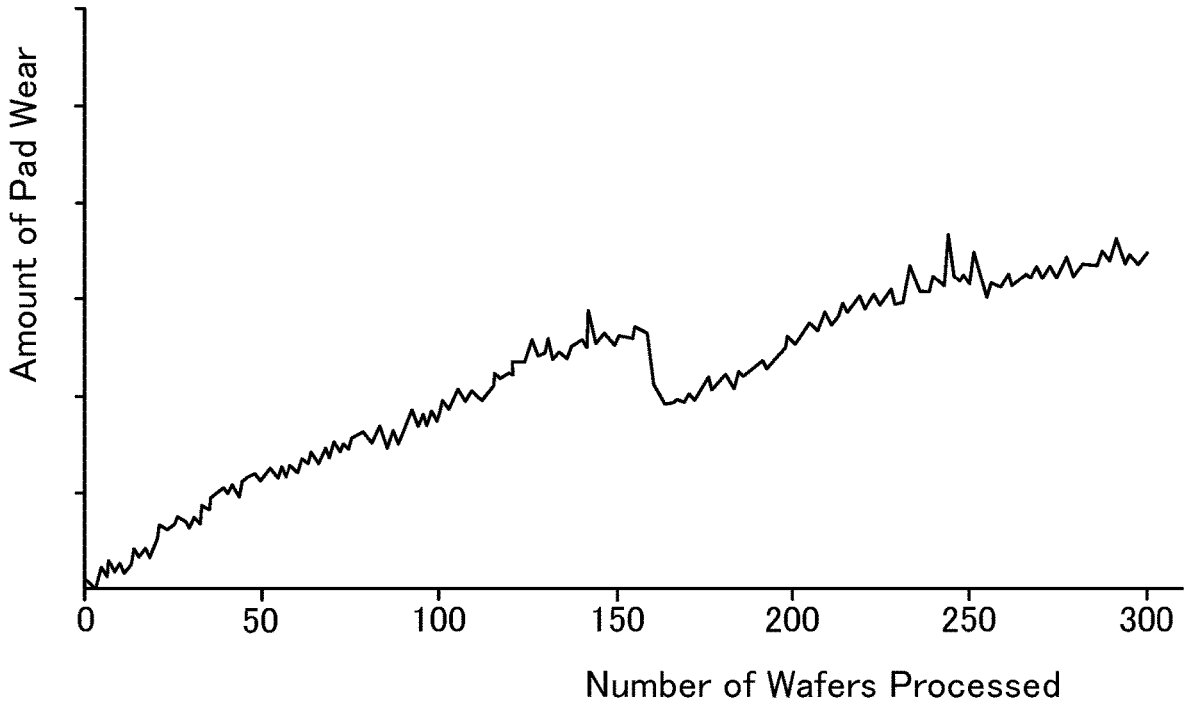
FIG. 21 is a graph illustrating an example of measured values of amounts of wear of the polishing pad versus the number of wafers processed.

FIG. 21 is a graph illustrating an example of amounts of wear of the pad versus the number of wafers processed and shows that at a point in time when the number of wafers processed is approximately 150, an abnormality (contraction of the pad) in the amount of wear of the pad in an idle time of the wafer processing has occurred. The pad height correction section 51 according to the present embodiment detects such an abnormality (contraction of the pad) of the amount of wear of the pad, subtracts the aforementioned correction value from the polishing pad height data in a certain period (e.g., a period during which the amount of wear of the polishing pad used to calculate a cut rate becomes a set value or more) to thereby correct the cut rate.

Figure 22:
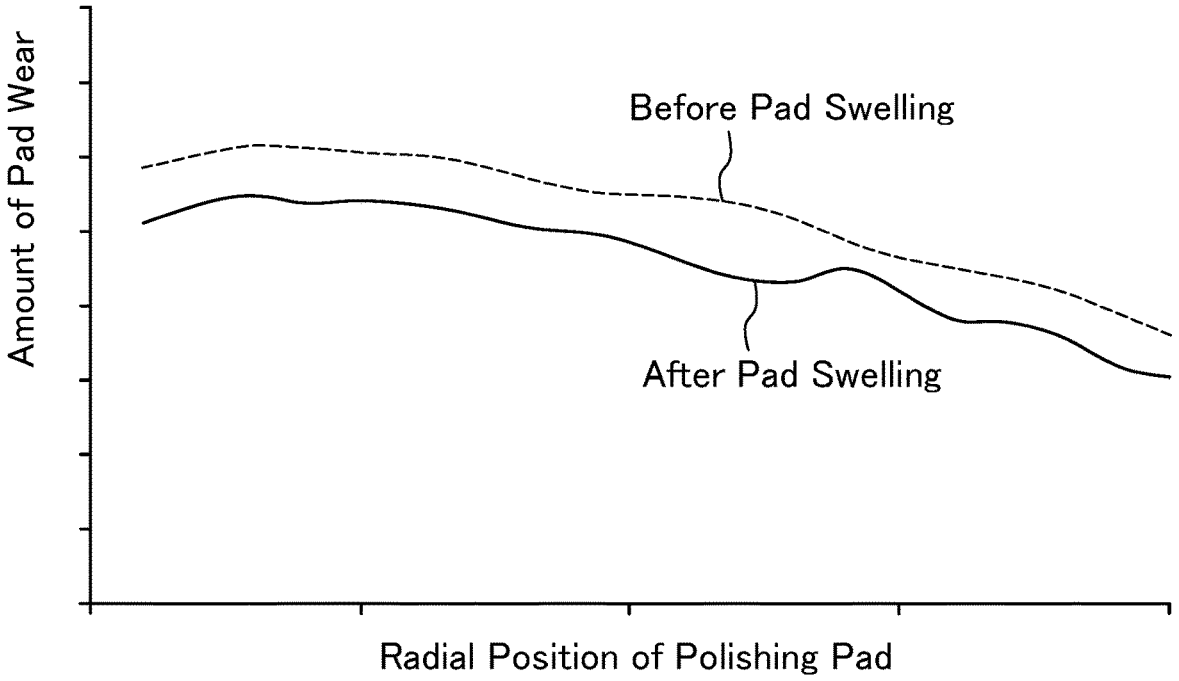
FIG. 22 is a graph illustrating an example of distribution of amounts of wear of the pad before and after swelling of the polishing pad; (a) showing a case where pad swelling or the like is corrected and (b) showing a case where pad swelling is not corrected.
Figure 22:
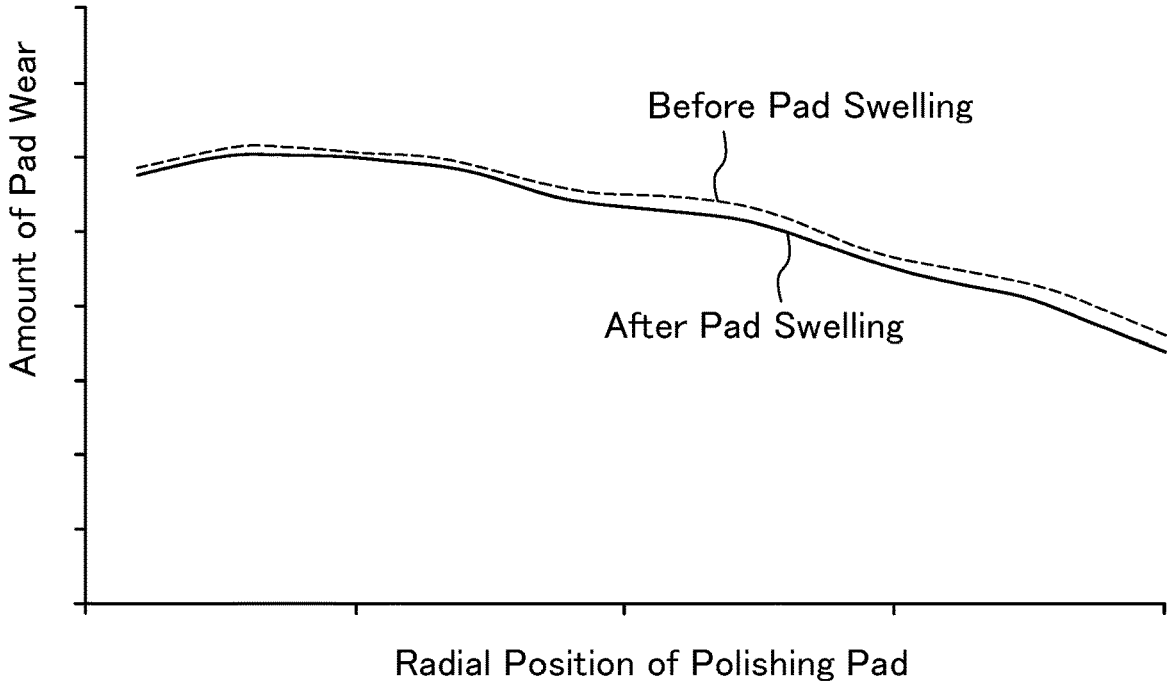

FIG. 22 is a graph illustrating a profile of amounts of wear of the polishing pad versus the monitoring area when contraction occurs in the polishing pad; (a) showing a case where the measured value is corrected and (b) showing a case where the measured value is not corrected. Note that a dotted line in each drawing indicates an amount of wear before contraction occurs in the polishing pad. Since the polishing pad height is detected as an average value including past measured values, it is possible to reliably capture a change of the amount of wear of the pad due to contraction of the polishing pad by making corrections for cases where measured values are not corrected.

Figure 23:
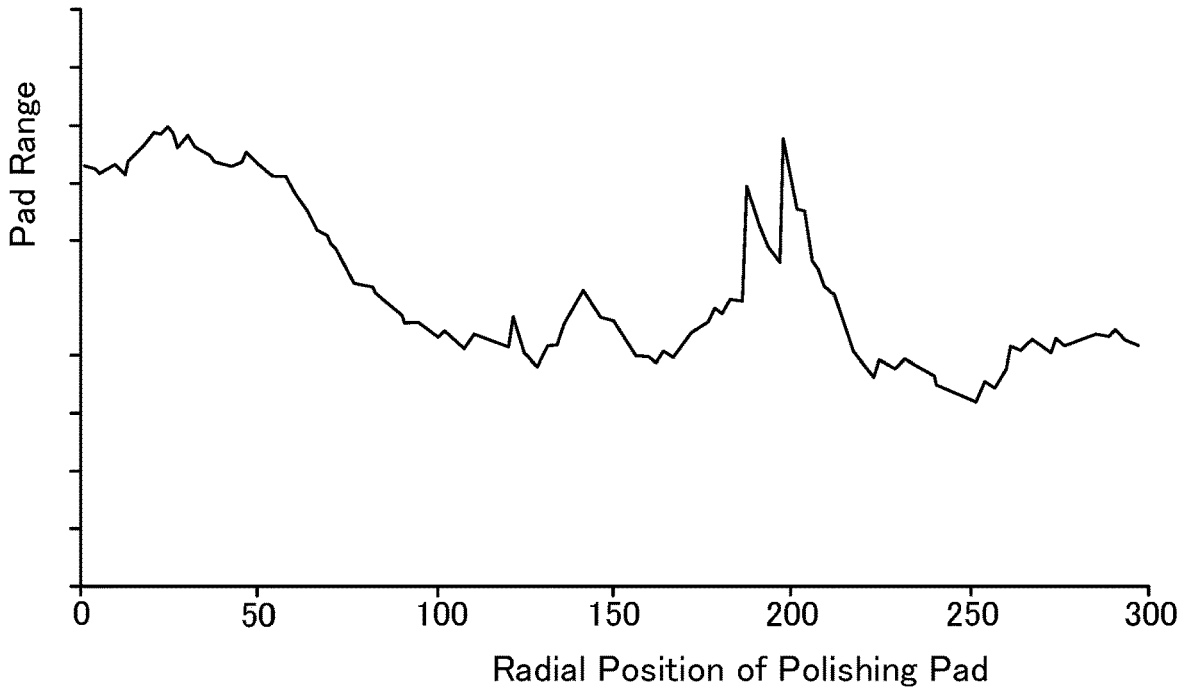
FIG. 23 is a graph illustrating an example of a profile range of the polishing pad versus the number of wafers processed; (a) showing a case where pad swelling or the like is corrected and (b) showing a case where pad swelling is not corrected.
Figure 23:
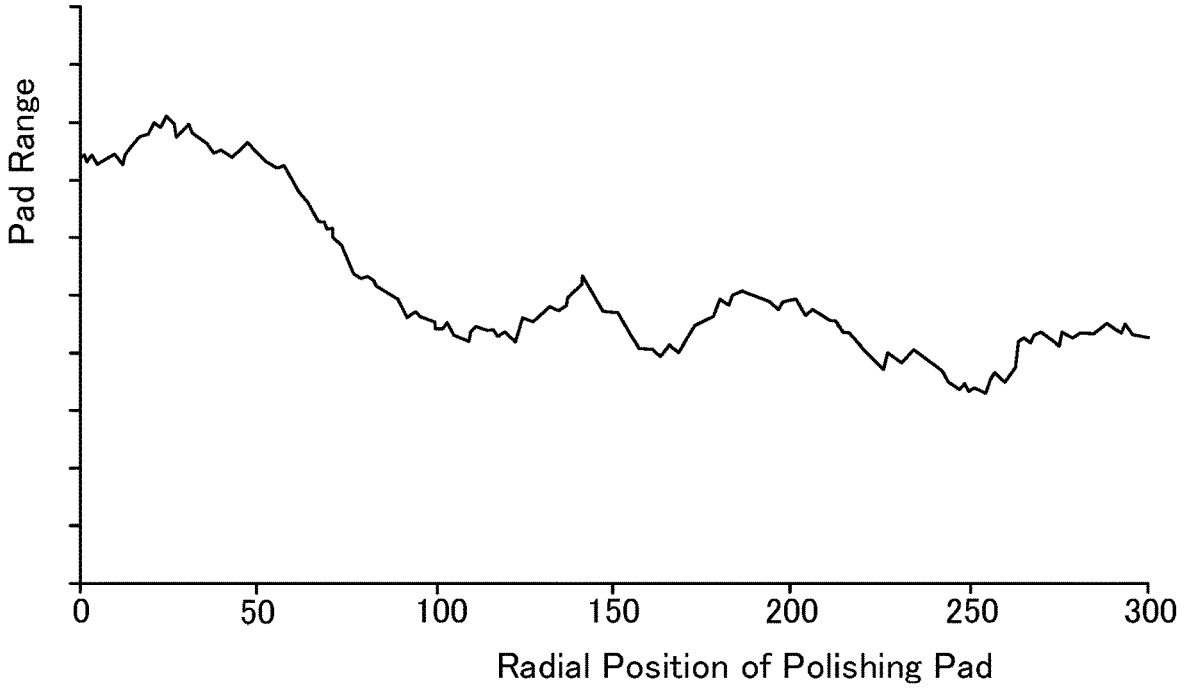

FIG. 23 is a graph illustrating a change of a pad range (pad profile) versus the number of wafers processed; (a) showing a case where measured values are corrected and (b) showing a case where measured values are not corrected. Here, the "pad range" (pad profile) indicates a difference between a maximum value and a minimum value of measured values of the height in a radius direction of the polishing pad. As described above, since the height of the polishing pad is detected as an average value including past measured values, it is possible to capture drastic changes of the pad range generated due to contraction of the polishing pad by making corrections for the case where no measured values are corrected.

Figure 24:
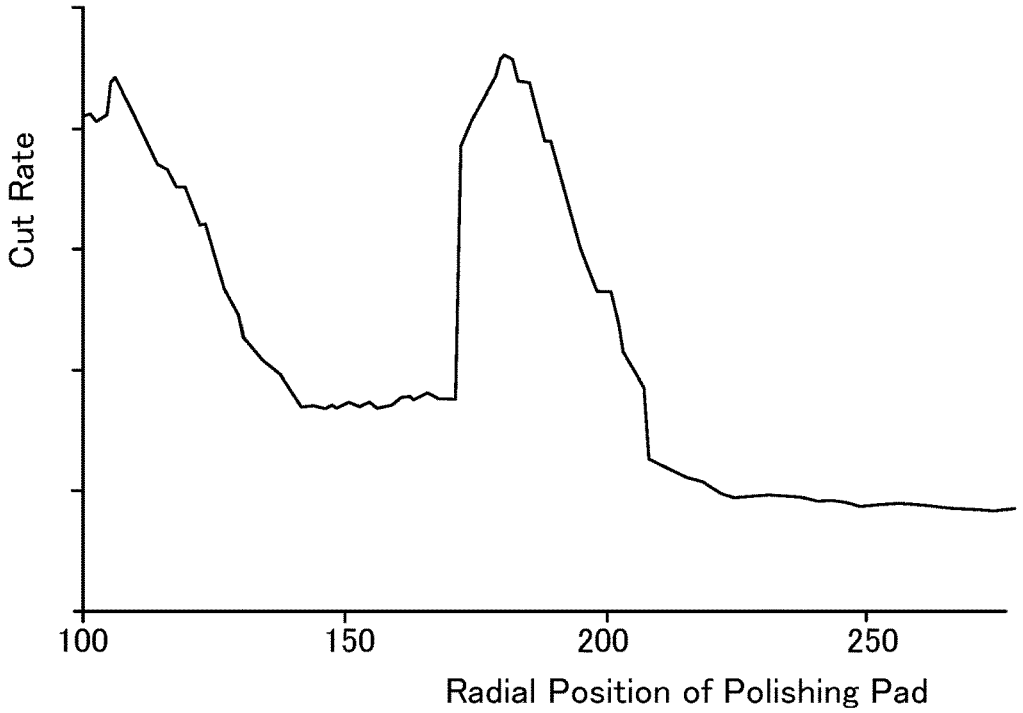
FIG. 24 is a graph illustrating an example of a change of the cut rate versus the number of wafers processed; (a) showing a case where pad swelling or the like is corrected and (b) showing a case where pad swelling is not corrected.
Figure 24:
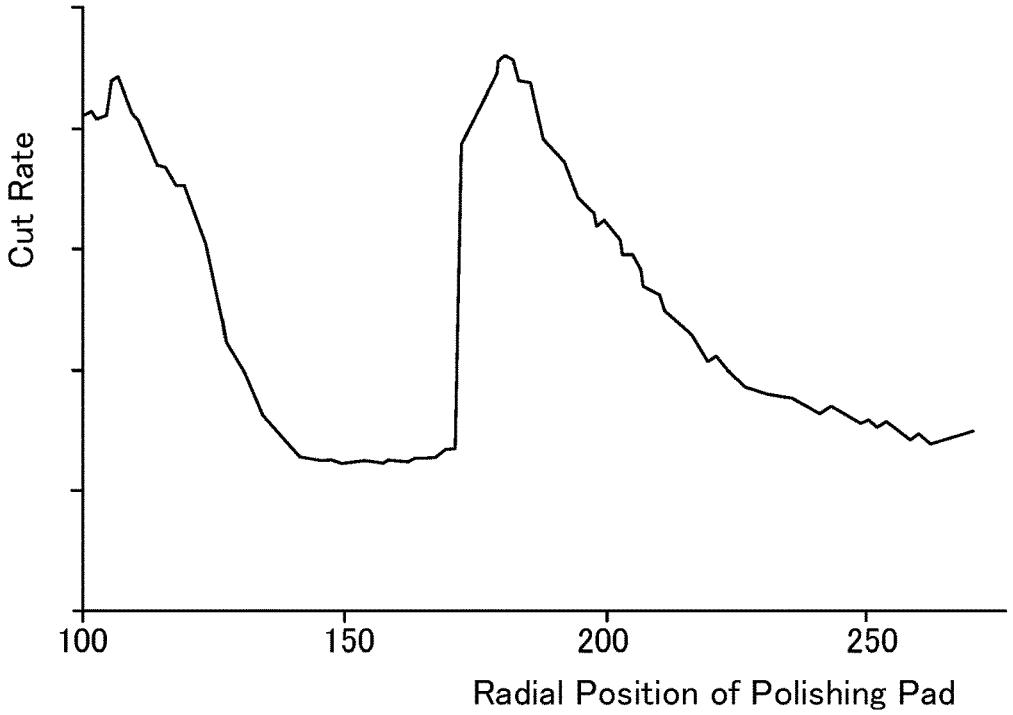

FIG. 24 is a graph illustrating a change of the cut rate versus the number of wafers processed; (a) showing a case where measured values are corrected and (b) showing a case where measured values are not corrected. Note that the graph in FIG. 24 shows one of a plurality of monitoring areas of the polishing pad. When measured values are not corrected, influences of contraction of the polishing pad are not immediately reflected, and many wafer processes are necessary to converge the change of the cut rate caused by contraction of the polishing pad (a delay time increases), but the convergence of the change of the cut rate is improved (converged more quickly) by performing correction processing.

Figure 25:
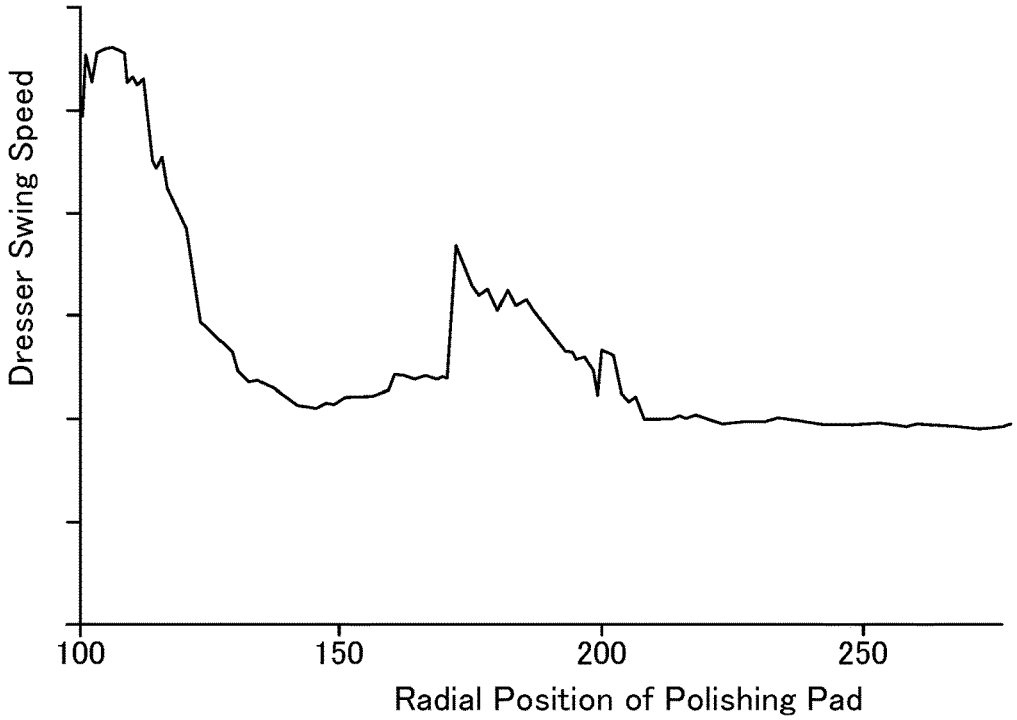
FIG. 25 is a graph illustrating an example of a change of a dresser swing speed versus the number of wafers processed; (a) showing a case where pad swelling or the like is corrected and (b) showing a case where pad swelling is not corrected.
Figure 25:
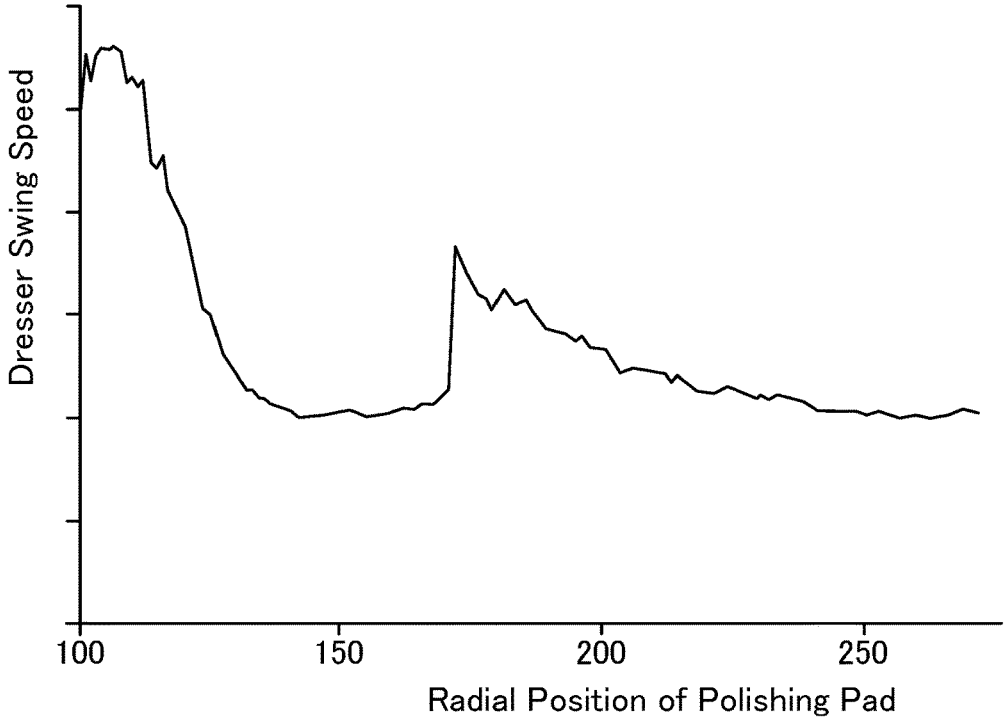

FIG. 25 is a graph illustrating a change of a dresser swing speed versus the number of wafers processed; (a) showing a case where measured values are corrected and (b) showing a case where measured values are not corrected. Note that the graph in FIG. 25 shows one of the plurality of monitoring areas of the polishing pad. When the measured values are not corrected, influences of contraction of the polishing pad are not immediately reflected and many wafer processes are necessary to converge the change of the dresser swing speed due to contraction of the polishing pad (delay time increases), but the convergence of the change of the dresser swing speed is improved (converged more quickly) by performing correction processing.

It is noted that when calculating the moving speed of the dresser, it is preferable to make the total dressing time fall within a predetermined value. The total dressing time here refers to a moving time for a total swing period by the dresser (scanning areas S1 to S7 in the present embodiment). Since an extended total dressing time (time required for dressing) may affect other processes such as a wafer polishing process and a transporting process, it is preferable to make corrections as appropriate on the moving speed in each scanning area so that this value does not exceed a predetermined value. Furthermore, since there is a restriction on the mechanism of the apparatus, it is preferable to set the moving speed of the dresser so that a maximum (and minimum) moving speed of the dresser and the ratio of a maximum speed (minimum speed) to the initial speed are within the set value.

In a combination of a new dresser and a polishing pad, if no appropriate dress condition is clear or no reference speed (reference staying time $T_0$) of the dresser is determined as in the case of immediately after replacement of the dresser or the polishing pad, the moving speed calculation section 45 may determine the evaluation index J (described below) using only a condition of deviation from the target cut amount to optimize the moving speed of the dresser (initial setting) in each scanning area.

$$J=|U-U_0|^2$$

The setting input section 46 is an input device such as a keyboard or a mouse, and inputs various parameters such as value of each component of dress model matrix S, setting of constraint conditions, cut rate update cycle and moving speed update cycle. The memory 47 also stores various kinds of data such as data of program to operate each component constituting a dressing monitoring apparatus 35, value of each component of the dress model matrix S, target profile, weighting value of the evaluation index J and set value of the moving speed of the dresser.

Figure 26:
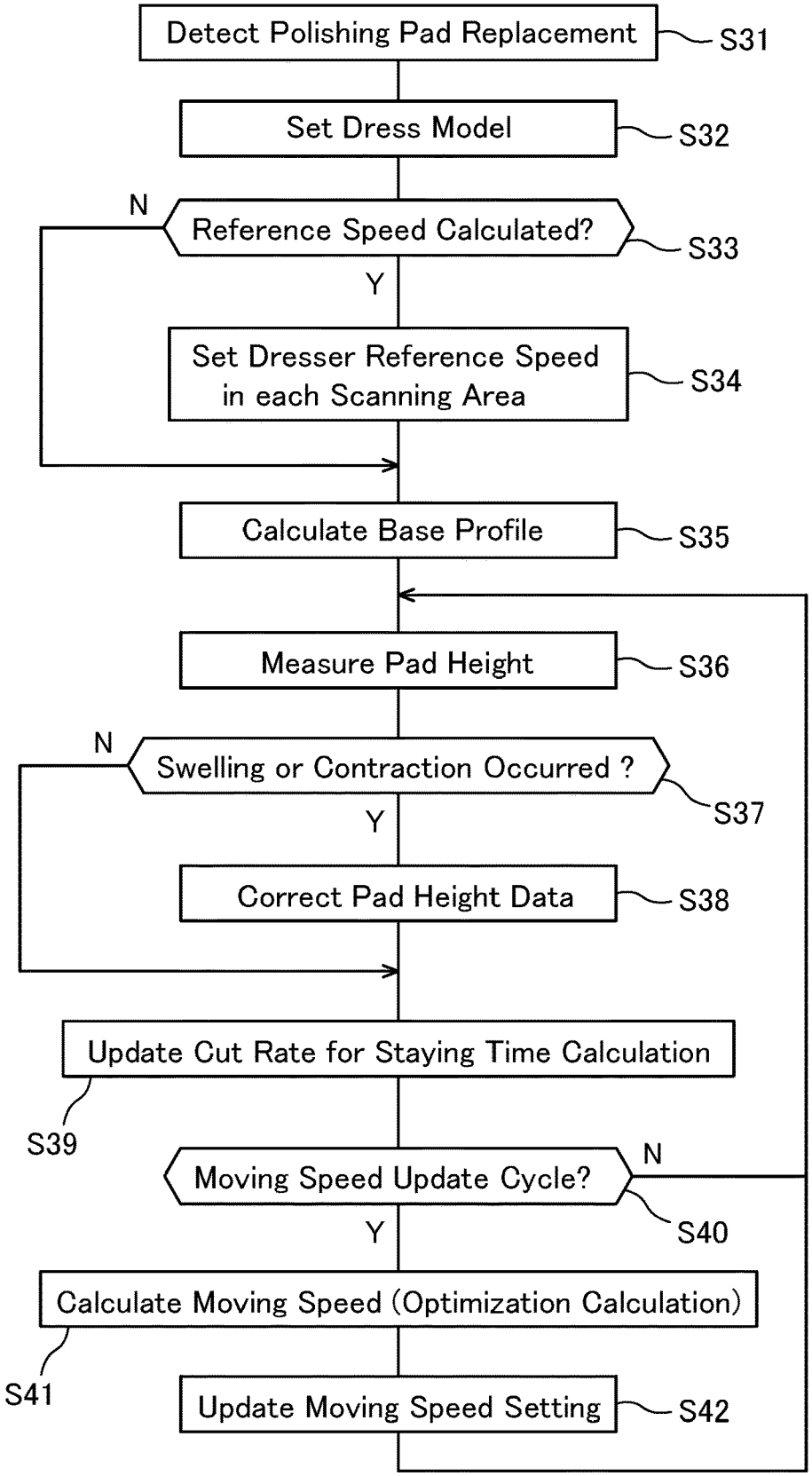
FIG. 26 is a flowchart illustrating an example of a procedure for adjusting the moving speed of the dresser.

FIG. 26 is a flowchart illustrating a procedure for controlling the moving speed of the dresser. Upon detecting that the polishing pad 11 has been replaced (step S31), the dress model setting section 41 derives the dress model matrix S by taking into account parameters of the cut rate model, the dresser diameter and the scan speed control (step S32). Note that in the case of the same kind of pad, the dress model matrix can also be used continuously.

Next, it is determined whether or not to calculate a reference speed of the dresser (whether or not the setting input section 46 has input an instruction for calculating the reference speed) (step S33). When the reference speed is calculated, the moving speed calculation section 45 sets the moving speed (staying time T) of the dresser in each scanning area from the target cut amount $U_0$ of the dresser and the pad wear amount U in each monitoring area so that the next evaluation index J becomes a minimum value (step S34). The calculated reference speed may be set as an initial value of the moving speed.

$$J=|U-U_0|^2$$

After that when polishing processing on the wafer W is performed, if dressing processing on the polishing pad 11 is performed, the base profile calculation section 42 calculates a target profile (base profile) of the pad height at the time of convergence (step S35).

After that, when polishing processing on the wafer W is performed, if dressing processing on the polishing pad 11 is performed, the pad height sensor 32 measures the height (pad height) of the polishing surface 11*a* and the pad height detection section 48 detects a profile of the pad height (step S36).

The pad correction section 49 determines whether or not swelling or contraction has occurred in the polishing pad based on the measured value of the height of the polishing pad and the measurement time interval (step S37). Upon determining that swelling or contraction has occurred, the pad correction section 49 corrects pad height data in a past certain period using the amount of fluctuation in the measured value of the height of the polishing pad as a correction value (step S38). After that, the cut rate update section 43 calculates the cut rate of the dresser in each scanning area (step S39).

Furthermore, it is determined whether or not the moving speed update cycle of the dresser (e.g., polishing of a predetermined number of wafers W) has been reached (step S40) and if the moving speed update cycle has been reached, the moving speed setting section 45 calculates a staying time of the dresser corresponding to the minimum evaluation index J, and thereby optimizes the dresser moving speed in each scanning area (step S41). The value of the optimized moving speed is set and the moving speed of the dresser is updated (step S42). Thereinafter, the flow returns to step S16 and the above-described processing is repeated until the polishing pad 11 is replaced.

It is noted that the calculation interval of the cut rate is preferably determined by a combination of the polishing pad and the dresser. As for the method for calculating the cut rate, it may be possible to select any one of a method for calculating the cut rate from the initial pad height and the height of the current polishing pad (measured value) and a method for calculating the cut rate from the pad height when the last cut rate is calculated and the height of the current polishing pad.

Furthermore, the monitoring target is not limited to the height of the polishing pad but it may be possible to calculate the moving speed so as to measure surface roughness of the polishing pad and uniformize the surface roughness.

The above-described embodiment has been described with the intention to allow a person ordinarily skilled in the art to which the present invention belongs to implement the present invention. Various modifications of the above-described embodiment can be naturally implemented by those skilled in the art and the technical thought of the present invention is also applicable to other embodiments. The present invention is not limited to the described embodiment, but should be interpreted within a broadest possible scope according to the technical thought defined in the scope of the appended claims.

What is claimed is:

1. A method for dressing a polishing member by causing a dresser to swing on the polishing member used for a polishing apparatus for a substrate, the dresser being enabled to adjust a swing speed in a plurality of scan areas set on the polishing member along a swing direction, the method comprising:

a step of measuring a surface height of the polishing member in a plurality of monitoring areas set in advance on the polishing member along the swing direction of the dresser;

a step of correcting the surface height of the polishing member based on a measurement interval of the surface height and an amount of fluctuation in a measured value of the surface height;

a step of creating a dress model matrix defined from the monitoring area, the scan area and a dress model;

a step of calculating a height profile predicted value using the dress model and the swing speed in each scan area or a staying time;

a step of setting an evaluation index based on a difference from a target value of a height profile of the polishing member; and a step of setting the swing speed in each scan area of the dresser based on the evaluation index.

2. The method according to claim 1, wherein the step of correcting is performed when the measurement interval of the surface height exceeds a reference value and when the amount of fluctuation in the measured value of the surface height exceeds a threshold.

3. The method according to claim 2, wherein the threshold when the measured value of the surface height increases and the threshold when the measured value of the surface height decreases have different values.

4. The method according to claim 1, wherein in the step of correcting, the amount of fluctuation in the measured value of the surface height is added to or subtracted from the measured value of the surface height for a past certain period.

5. A polishing apparatus that polishes a substrate placed on and in slidable contact with a polishing member, comprising:

a dresser that dresses the polishing member by swinging on the polishing member, a swing speed of which is adjustable in a plurality of scan areas set on the polishing member along a swing direction;

a height detection section that measures a surface height of the polishing member in a plurality of monitoring areas set in advance on the polishing member along the swing direction of the dresser;

a height correction section that corrects the surface height of the polishing member based on a measurement interval of the surface height and an amount of fluctuation in the measured value of the surface height;

a dress model matrix creation section that creates a dress model matrix defined from a plurality of monitoring areas, scan areas and dress models;

an evaluation index creation section that calculates a height profile predicted value using the dress model and the swing speed in each scan area or a staying time and sets an evaluation index based on a difference from a target value of a height profile of the polishing member; and a moving speed calculation section that calculates the swing speed in each scan area of the dresser based on the evaluation index.

* * * * *